US010336072B2

(12) United States Patent
Toda et al.

(10) Patent No.: US 10,336,072 B2
(45) Date of Patent: Jul. 2, 2019

(54) LIQUID EJECTION HEAD EJECTING LIQUID, LIQUID EJECTION APPARATUS, AND METHOD FOR MANUFACTURING LIQUID EJECTION HEAD

(71) Applicant: CANON KABUSHIKI KAISHA, Tokyo (JP)

(72) Inventors: Kyosuke Toda, Kawasaki (JP); Yasushi Iijima, Tokyo (JP); Tomohisa Atsuta, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/910,991

(22) Filed: Mar. 2, 2018

(65) Prior Publication Data

US 2018/0257373 A1 Sep. 13, 2018

(30) Foreign Application Priority Data

Mar. 10, 2017 (JP) ..... 2017-046211
Mar. 10, 2017 (JP) ..... 2017-046419

(51) Int. Cl.
*B41J 2/14* (2006.01)
*B41J 2/175* (2006.01)
*B41J 2/16* (2006.01)

(52) U.S. Cl.
CPC ..... *B41J 2/1433* (2013.01); *B41J 2/1623* (2013.01); *B41J 2/175* (2013.01); *B41J 2202/22* (2013.01)

(58) Field of Classification Search
CPC ..... B41J 2/21433; B41J 2/1623; B41J 2/175; B41J 2202/22
See application file for complete search history.

(56) References Cited

U.S. PATENT DOCUMENTS

2013/0222489 A1* 8/2013 Takahashi ..... B41J 2/175 347/85

FOREIGN PATENT DOCUMENTS

JP 2007276385 A 10/2007
JP 2011079246 A * 4/2011

* cited by examiner

*Primary Examiner* — Sharon A. Polk
(74) *Attorney, Agent, or Firm* — Canon U.S.A., Inc. IP Division

(57) ABSTRACT

A liquid ejection head includes a recording element board, a support member that supports the recording element board, and includes a first surface having a plurality of first openings that communicate with a first supply port and a second supply port, a second surface contacting a supply member and having a second opening that communicates with a supply path, and a flow path through which the plurality of first openings and the second opening communicate with each other. The support member includes a beam that is provided between the plurality of first openings and extends from the first surface to middle of the flow path, and in an arrangement direction of the plurality of first openings, a length of the second opening is shorter than a sum of lengths of the plurality of first openings and a length of the beam on the first surface.

17 Claims, 17 Drawing Sheets

LIQUID EJECTION HEAD EJECTING LIQUID, LIQUID EJECTION APPARATUS, AND METHOD FOR MANUFACTURING LIQUID EJECTION HEAD

BACKGROUND OF THE INVENTION

Field of the Invention

The present disclosure relates to a liquid ejection head ejecting liquid, a liquid ejection apparatus, and a manufacturing method therefor.

Description of the Related Art

A liquid ejection head (inkjet recording head, also simply referred to as a "head") that ejects recording liquid such as ink to perform recording on a recording medium is used as a means of forming a photograph, a document, a 3-dimensional structure, and the like. In order to cope with demand for an increase in density and speed for image recording, Japanese Patent Laid-Open No. 2007-276385 provides a configuration in which a beam for promoting heat dissipation of a head is provided in a support member that supports a recording element board including an element for performing recording. A supply member for supplying liquid to the recording element board is bonded to the support member and liquid is supplied from the supply member to the recording element board through a flow path provided in the support member.

However, when the beam as described in Japanese Patent Laid-Open No. 2007-276385 is provided in the support member, a sectional area of the flow path provided in the support member is reduced, so that air bubbles are accumulated in the flow path and it is concerned that the air bubbles prevent the liquid from being supplied to the recording element board. In particular, when the flow path is further narrowed due to downsizing of a main body of a liquid ejection apparatus and downsizing of the head associated therewith, supply efficiency of the liquid is more likely to be reduced due to the accumulation of the air bubbles.

When an interval between a plurality of flow paths is reduced to cope with the downsizing of the head, it is difficult to sufficiently ensure a bonding region between the support member and the supply member which is bonded thereto and bonding may be insufficient. In particular, when bonding is insufficient in a configuration in which liquids of different colors flow through adjacent flow paths, color mixture may be caused.

Accordingly, it would be advantageous to provide a liquid ejection head that includes a support member capable of ensuring a sufficient bonding region while preventing air bubbles from being accumulated.

SUMMARY OF THE INVENTION

A liquid ejection head of the disclosure includes a recording element board including a first element and a second element that are used to perform recording, a first supply port that supplies liquid to the first element, and a second supply port that supplies liquid to the second element, a supply member including a supply path through which liquid is supplied to the recording element board, a support member that supports the recording element board, and includes a first surface having a plurality of first openings that communicate with the first supply port and the second supply port, a second surface contacting the supply member and having a second opening that communicates with the supply path, and a flow path through which the plurality of first openings and the second opening communicate with each other, in which the support member includes a first beam that is provided between the plurality of first openings and extends from the first surface to middle of the flow path, and in an arrangement direction of the plurality of first openings, a length of the second opening is shorter than a sum of lengths of the plurality of first openings and a length of the first beam on the first surface.

Further features and aspects of the present disclosure will become apparent from the following description of multiple example embodiments with reference to the attached drawings.

DESCRIPTION OF THE EMBODIMENTS

Example First Embodiment (Liquid Ejection Head)

Figure 1:
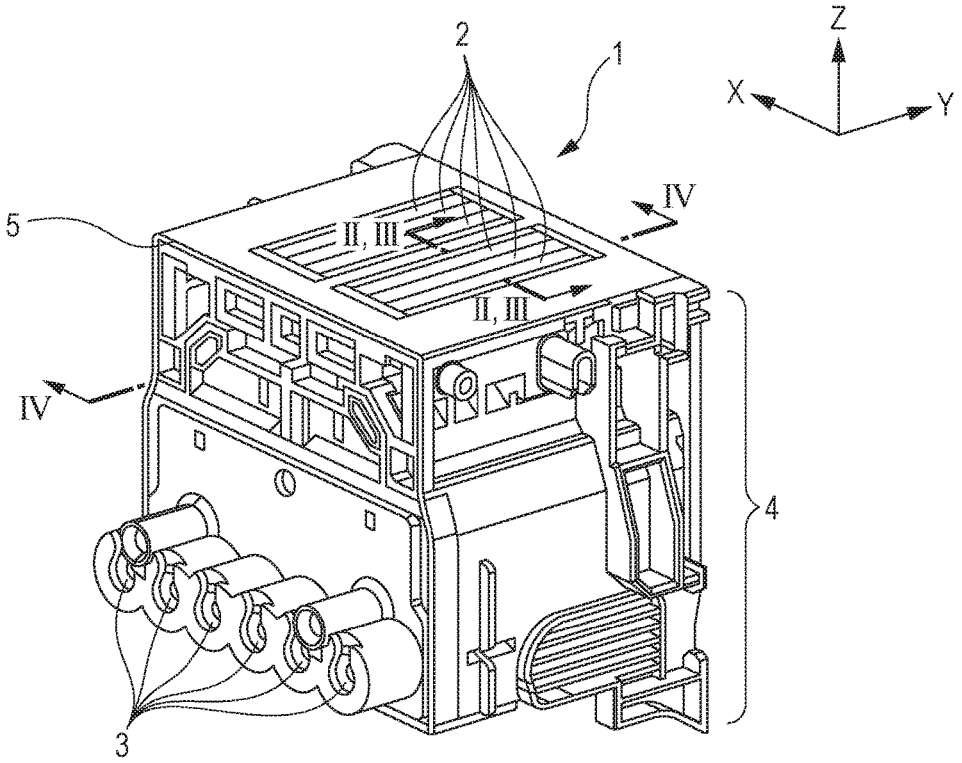
FIG. 1 is a perspective view of a liquid ejection head of an example first embodiment of the disclosure.

FIG. 1 is a perspective view illustrating a liquid ejection head 1 to which the disclosure is able to be applied. The liquid ejection head 1 includes a recording element board 2 provided with a recording element 17 (FIG. 3) that generate energy for performing recording and an ejection port 9 (FIG. 3) through which liquid is ejected. As the recording element 17, for example, an electro-thermal conversion element that generates thermal energy is able to be used. The liquid ejection head 1 also includes a support member 5 that supports the recording element board 2, and a liquid supply member 4 that supplies liquid to the recording element board 2 through a flow path 14 (FIG. 2) provided in the support member 5. The liquid supply member 4 includes an inlet port 3 to which a tube or the like is connected from a main tank in which liquid such as ink is reserved, a sub tank in which the ink supplied from the inlet port 3 is reserved, and a flow path 16 (FIG. 2) as a supply path through which liquid flows to the flow path 14 provided in the support member 5. The liquid supply member 4 is able to be formed through injection molding using a resin material, for example.

Figure 2:
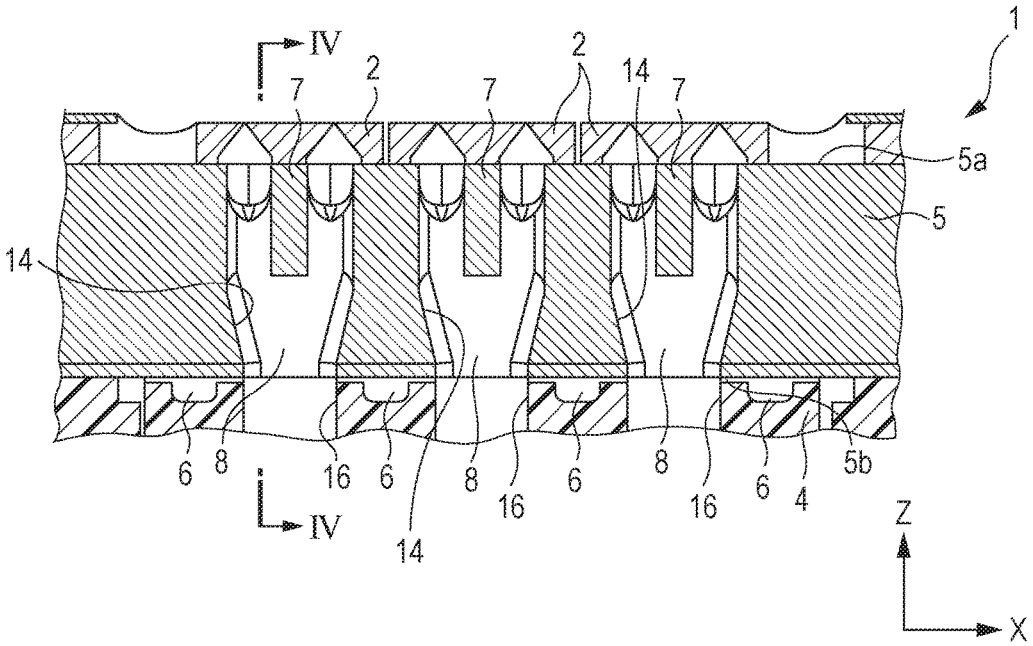
FIG. 2 is a sectional view of the liquid ejection head taken along a line II-II in FIG. 1.

FIG. 2 is a partial sectional view taken along a line II-II in FIG. 1. The recording element board 2 and the support member 5 are bonded to each other via an adhesive. The support member 5 and the liquid supply member 4 are bonded to each other via an adhesive 6. A surface of the support member 5 on the recording element board 2 side is also referred to as a first surface 5*a* and a surface of the support member 5 opposite to the first surface 5*a* and on the liquid supply member 4 side is also referred to as a second surface 5*b*. The liquid ejection head 1 includes a plurality of recording element boards 2. From the inlet port 3 provided in the liquid supply member 4, liquids of different colors pass through the flow path 16 and are supplied to the plurality of recording element boards 2 via the flow path 14 of the support member 5. Thus, the plurality of recording element boards 2 are able to eject liquids of mutually different colors.

Figure 3:
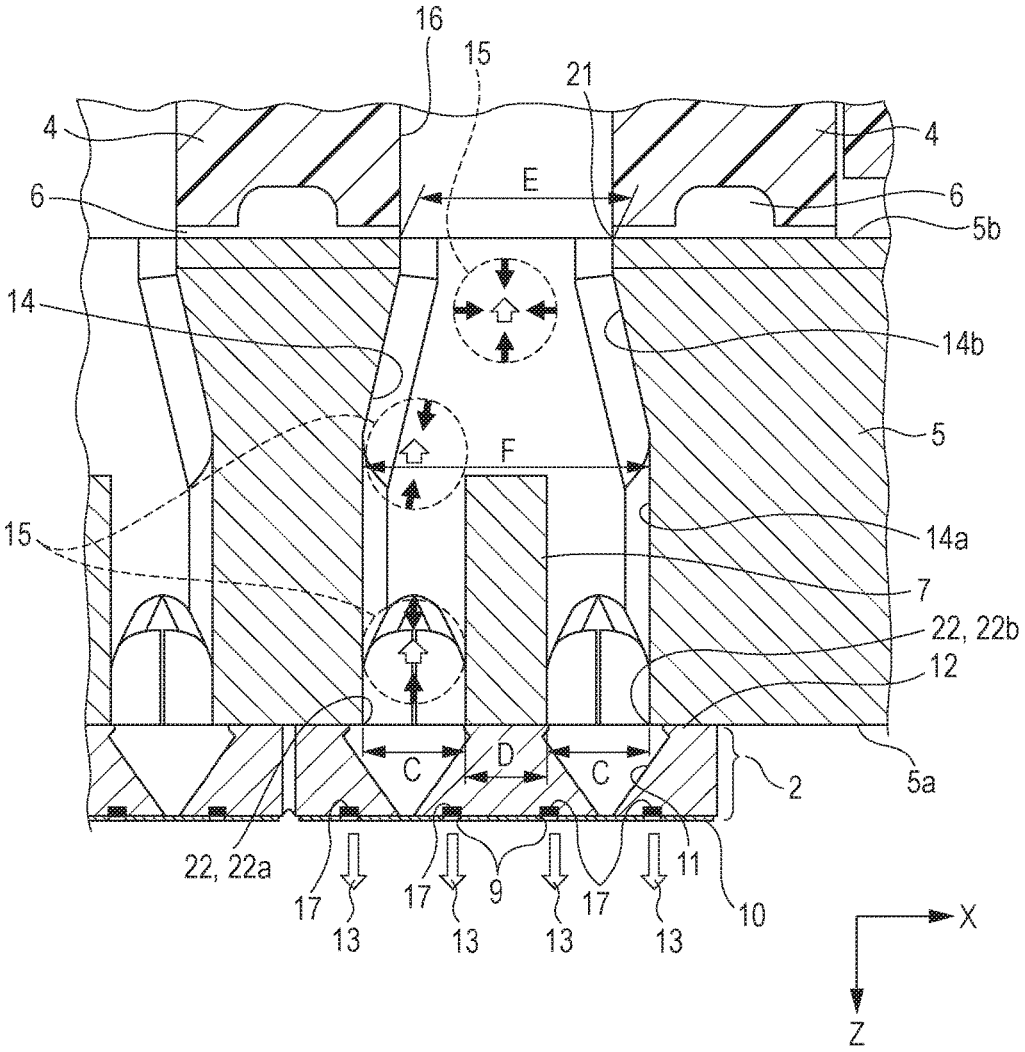
FIG. 3 is an enlarged sectional view of the liquid ejection head taken along the line III-III in FIG. 1.

FIG. 3 is an enlarged partial sectional view taken along the line III-III in FIG. 1. FIG. 3 illustrates a posture of the liquid ejection head 1 to perform recording, that is, a posture of the head 1 in a usage state, and has an up and down direction reversed to that of FIG. 2. The recording element board 2 includes an ejection port plate 10 in which the ejection port 9 through which liquid is ejected is formed, and a base 12 on which the recording element 17 and a supply port 11 are formed, and ejects liquid droplets in a direction of an arrow 13. In the present embodiment, a recording element array is disposed on both sides of one supply port 11. The recording element array is constituted in such a manner that a plurality of recording elements 17 are arrayed along a Y direction. One recording element board 2 has two supply ports 11 and four recording element arrays. The recording element board 2 has ejection port arrays corresponding to the respective recording element arrays.

In the present embodiment, the supply port 11 has a length in a direction along the recording element array longer than a length in a direction intersecting the recording element array.

(Support Member)

Figure 4A:
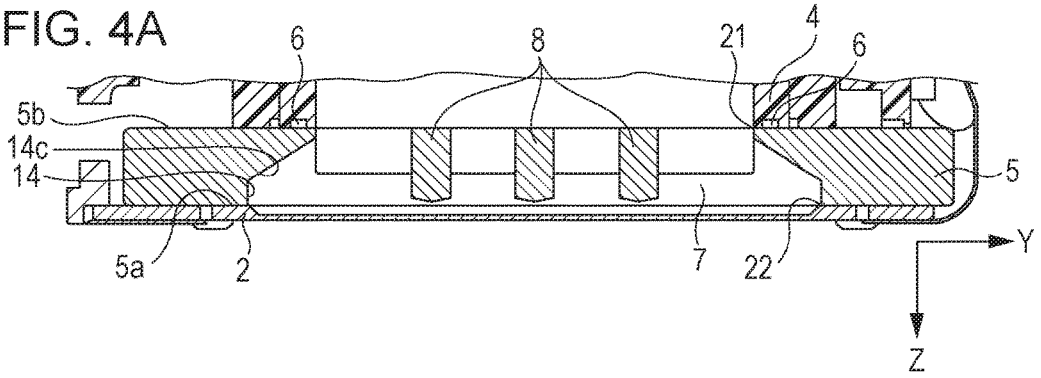
FIGS. 4A to 4D are sectional views of the liquid ejection head taken along a line IV-IV in FIG. 1 or 2.
Figure 4B:
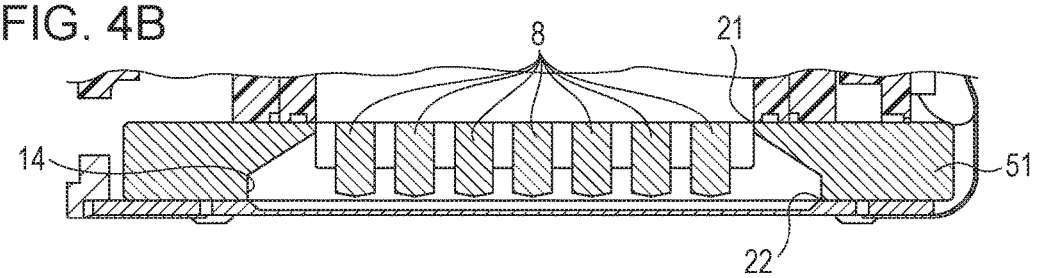
Figure 4C:
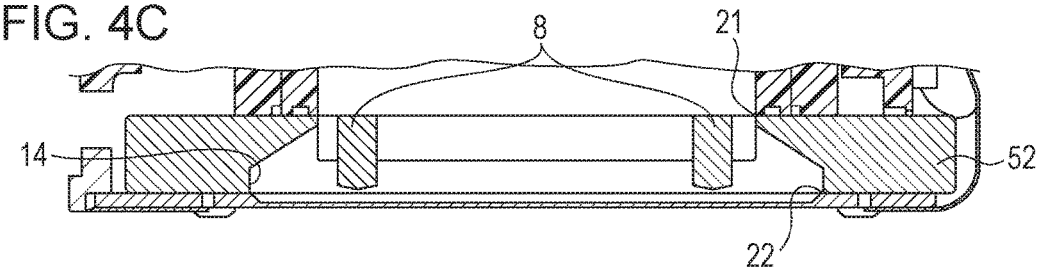
Figure 4D:
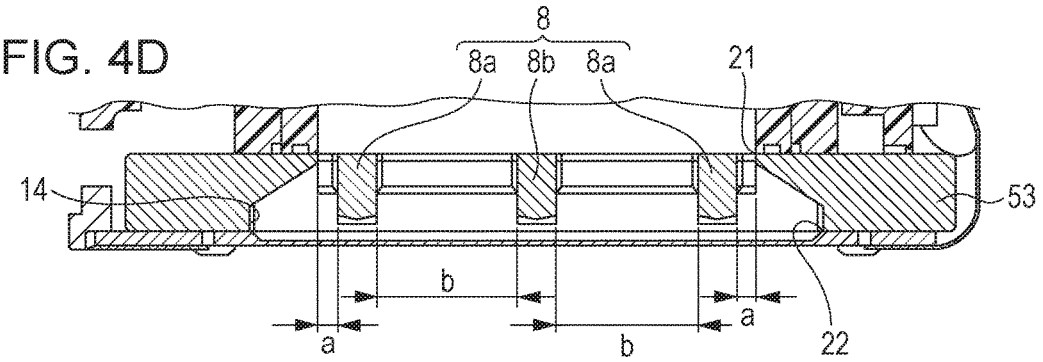
Figure 5A:
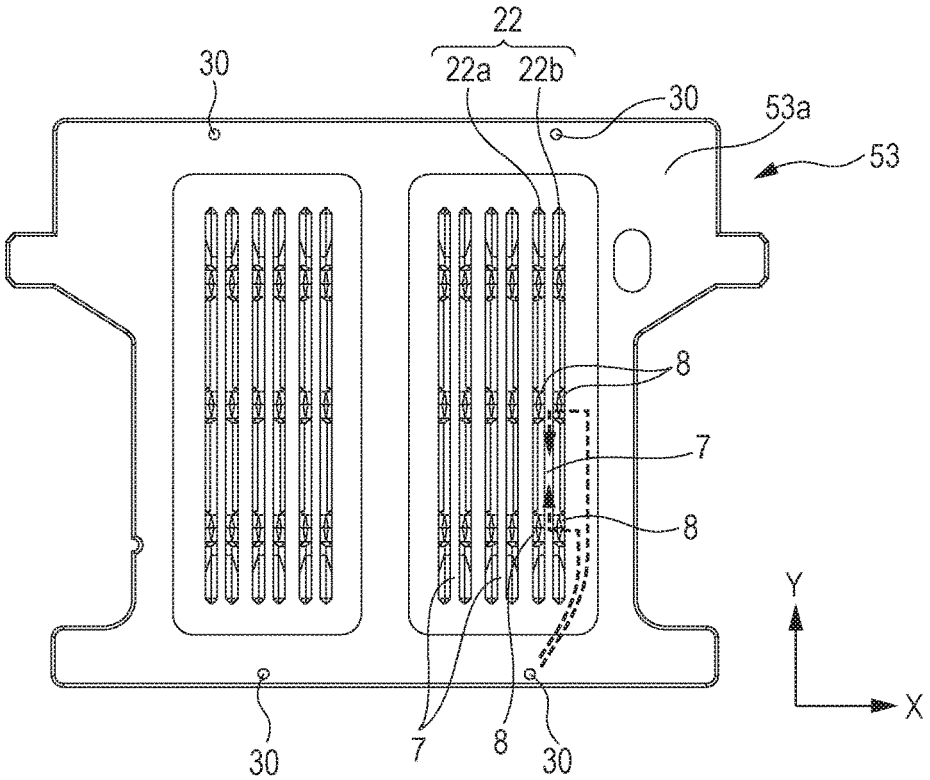
FIGS. 5A and 5B are plan views of the support member when viewed from a first surface and a second surface, respectively.
Figure 5B:
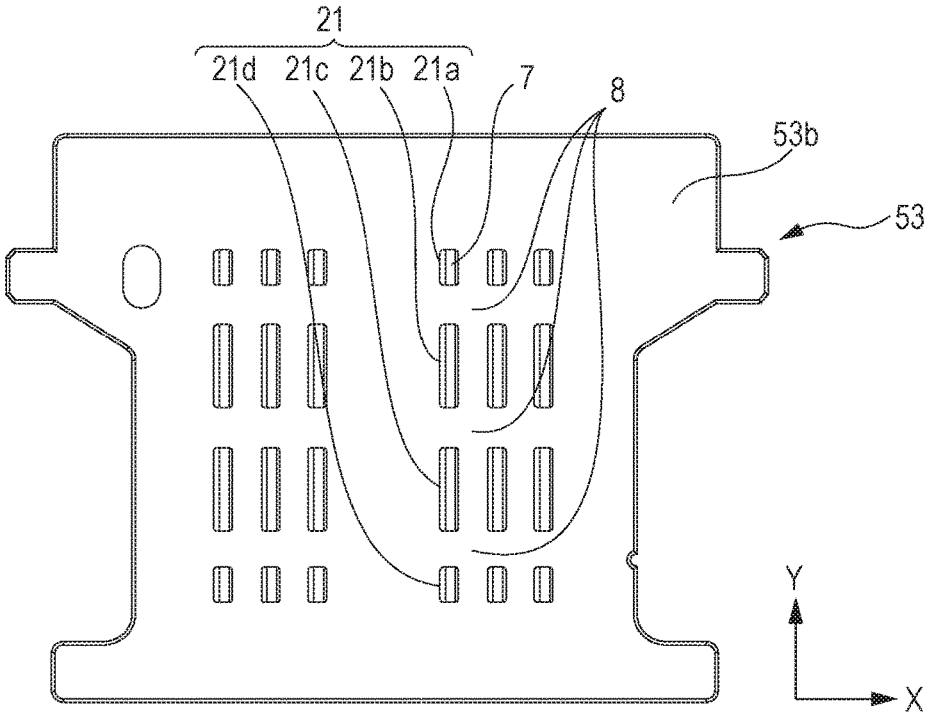

With reference to FIGS. 2, 3, 4A to 4D, and 5A and 5B, the support member 5 that constitutes the liquid ejection head 1 will be described. FIGS. 4A to 4D are partial sectional views of the liquid ejection head 1 taken along a line IV-IV illustrated in FIG. 1 or 2. FIG. 4A illustrates the liquid ejection head 1 that has the support member 5, and FIGS. 4B to 4D illustrate liquid ejection heads that have support members 51 to 53 described later, respectively. FIG. 5A is a plan view of the support member 53 when viewed from a first surface 53*a* that is a surface on the recording element board 2 side and FIG. 5B is a plan view of the support member 53 when viewed from a second surface 53*b* that is a surface on the liquid supply member 4 side. Note that, the support member 5 and the support member 53 are different in a position at which a beam 8 described later is provided, but similar in other configurations.

The support member 5 also serves as a flow path member that causes liquid to flow from the liquid supply member 4 to the recording element board 2 and as a heat-dissipating member that dissipates heat accumulated in the recording element board 2 with ejection of the liquid. In order to ensure heat-dissipating performance, the support member 5 can be made from a material having high thermal conductivity such as aluminum oxide ($Al_2O_3$), for example.

As illustrated in FIG. 3, the support member 5 is provided with the flow path 14 through which the liquid supplied from the flow path 16 of the liquid supply member 4 flows to the supply port 11 of the recording element board 2. By the flow path 14, a first opening 22 provided on the first surface 5*a* of the support member 5 that is the surface on the recording element board 2 side communicates with a second opening 21 provided on the second surface 5*b* that is the surface on the liquid supply member 4 side.

The support member 5 is provided with a beam 7, and a surface of the beam 7 on the recording element board 2 side contacts a region between adjacent supply ports 11 on the surface of the recording element board 2 on the support member 5 side. By providing the beam 7 so as to correspond to the region between the supply ports 11 on the recording element board 2 as described above, heat dissipation for the recording element board 2 through the beam 7 is promoted, so that an increase in temperature of the recording element board 2 is able to be suppressed.

As illustrated in FIG. 5A, the beam 7 extends in the Y direction so as to connect each end of first openings 22 in the Y direction. Thus, the first opening 22 is divided into a plurality of first openings 22*a* and 22*b* by the beam 7. In other words, the beam 7 is provided between the plurality of first openings 22*a* and 22*b* that are adjacent to each other.

Further, as illustrated in FIG. 3, the beam 7 is configured not to extend up to the liquid supply member 4 side in a Z direction and but to extend from the first surface 5*a* to the middle of the flow path 14. Such a configuration of the beam 7 makes it easier to ensure an opening area of the second opening 21 compared to a configuration in which a beam extends from the first opening 22 to the second opening 21, so that it is possible to prevent accumulation of air bubbles and reduction in liquid supply efficiency while the beam 7 is provided.

Hereinafter, in the flow path 14 by which the first opening 22 and the second opening 21 communicate with each other, a part in which the beam 7 extends from the first opening 22*a* (or the first opening 22*b*) is also referred to as a flow path part 14*a* and a part in which no beam 7 is provided is also referred to as a flow path part 14*b*, as illustrated in FIG. 3.

As illustrated in FIG. 5B, the support member 5 (53) is provided with the beam 8 that intersects (in the present embodiment, that is orthogonal to) the Y direction in which the beam 7 extends. The beam 8 extends in an X direction so as to connect an inner wall of the flow path 14 and a wall of the beam 7 facing the flow path 14. The beam 8 is provided on the second surface 5*b* that is the surface of the support member 5 on the liquid supply member 4 side. Thus, the second opening 21 is divided by the beam 8 into a plurality of second openings 21*a*, 21*b*, 21*c*, and 22*d*. In other words, the beam 8 is provided between adjacent second openings of the plurality of second openings 21*a* to 21*d*.

Further, as illustrated in FIG. 4A, the beam 8 is configured not to extend up to the recording element board 2 side in the Z direction but to extend from the second surface 5*b* to the middle of the flow path 14. Such a configuration of the beam 8 makes it easier to ensure an opening area of the first opening 22 compared to a configuration in which a beam extends from the second opening 21 to the first opening 22, so that it is possible to prevent accumulation of air bubbles and reduction in liquid supply efficiency while the beam 8 is provided. Note that, a heat-dissipating effect achieved by providing the beam 8 will be described later.

In a case where the beam 7 and the beam 8 that extend in directions intersecting each other are provided, the beam 7 can be configured to extend from the first surface 5*a* of the support member 5 to the middle of the flow path 14 and the beam 8 can be configured to extend from the second surface 5*b* of the support member 5 to the middle of the flow path 14, as in the present embodiment. This is because the configuration in which the beams extend from surfaces that face each other to the middle of the flow path 14 makes it easier to ensure the opening area of the first opening 22 and the opening area of the second opening 21, and it is possible to prevent reduction in liquid supply efficiency.

Here, shapes of the first opening 22 and the second opening 21 will be described. As illustrated in FIG. 5A, the first opening 22 (22*a* and 22*b*) has a length in a direction (Y direction) along the recording element array longer than a length in an intersecting direction (the X direction orthogonal to the Y direction in the present embodiment), similarly to the supply port 11 of the recording element board 2 described above. Moreover, as illustrated in FIG. 5B, the second opening 21 also has a length in the direction (Y direction) along the recording element array longer than a length in the intersecting direction (the X direction). Further, each of the plurality of second openings 21*a* to 21*d* divided by the beam 8 also has a length in the Y direction longer than a length in the X direction.

Meanwhile, in a case where an air bubble 15 generated when recording is performed or an air bubble 15 flowing from the liquid supply member 4 side during suction recovery is accumulated near the first opening 22, supply of the liquid may be prevented. In particular, when the beam 7 or the beam 8 is provided for promoting heat dissipation to the support member 5 in order to obtain small temperature distribution in the recording element board 2, a sectional area of the flow path 14 is reduced, so that it is required to prevent the air bubble 15 from being accumulated near the first opening 22.

Thus, the flow path 14 is assumed to have the following size of width in the present embodiment. The width here refers to a length in the X direction illustrated in FIG. 3. Note that, the X direction in the present embodiment is a direction in which the plurality of first openings 22*a* and 22*b* are arranged. As illustrated in FIG. 3, a width E of the second opening 21 positioned in an upper part of the head 1 in the usage state is greater than a width C of one first opening 22*a* (22*b*). A width F of a middle part of the flow path 14 is greater than the width C of the first opening 22*a* (22*b*). Since the beam 7 is configured to extend from the first surface 5*a* to the middle of the flow path 14 as described above, it is possible to sufficiently increase the width F of the middle part of the flow path 14 while the beam 7 is provided in the support member 5.

As a result, the air bubble 15 is able to move to the upper part of the head 1 in the usage state, that is, to the second opening 21 side and move to the liquid supply member 4 in which a liquid chamber whose volume is greater than that of the flow path 14 of the support member 5 is provided.

Further, in the flow path 14, the flow path part 14*a* that is a part in which the beam 7 extends from the first opening 22*a* (or the first opening 22*b*) can be configured so that the width of the first opening 22*a* (22*b*) is the narrowest. That is, the width of the flow path part 14*a* can be substantially the same as or equal to or greater than the width of the first opening 22*a* (22*b*).

The movement of the air bubble 15 in the flow path 14 that is configured in this manner will be described below. The first opening 22*a* (22*b*) has the length in the X direction shorter than the length in the Y direction. Thus, it is possible to suppose that a maximum diameter of the air bubble 15 positioned near the first opening 22 is almost the same as the width C that is the length of the first opening 22 in the X direction. When an interval between the beam 7 and the inner wall of the flow path 14 is substantially constant (C) near the first opening 22 of the flow path part 14*a*, surface tension is equal between an upper side and a lower side of the air bubble 15 positioned near of the first opening 22, but the air bubble 15 moves toward the second opening 21 side by buoyancy on the air bubble 15. Since the width of the flow path part 14*b* of the flow path 14, in which no beam 7 is provided, is greater than the width C of the first opening 22*a*, the surface tension of the upper side is always smaller than that of the lower side. Thus, the air bubble 15 moves from the vicinity of the first opening 22 to the second opening 21, so that it is possible to further prevent the air bubble 15 from being accumulated near the first opening 22.

Note that, for example, in a case where the support member 5 is manufactured, for example, by CIM (ceramic injection molding), a member is molded to be inclined at a few degrees so that the molded member is easily removed from a mold in some cases. Though such an inclination may cause a case where the width C of the first opening 22*a* is not the narrowest in the flow path 14 (flow path part 14*a*), the inclination is only required to be provided to such an extent that a difference of the surface tension between the upper side and the lower side of the air bubble 15 is not greater than the buoyancy. This makes it possible for the air bubble 15 to move to the second opening 21 side by the buoyancy. In addition, also when the member is inclined at a few degrees as described above, the width of the flow path part 14*a* is able to be considered as substantially the same as the width of the first opening 22*a* (22*b*).

The width E of the second opening 21 of the support member 5 is smaller than a sum of the width C of the first opening 22*a*, the width C of the first opening 22*b*, and a width D of the beam 7 on the first surface 5*a* (that is, $E<2C+D$). Thereby, it is possible to sufficiently ensure an application region where the adhesive 6 is applied on the side of the support member 5 which is to be bonded to the liquid supply member 4. Thus, it is possible to sufficiently ensure a bonding region of the liquid supply member 4 to be bonded to the support member 5 and prevent occurrence of color mixture or the like between adjacent flow paths 14. Note that, also in a case where the liquid supply member 4 and the support member 5 are bonded to each other with a sealing member such as rubber without limitation to the adhesive 6, it is possible to ensure a region needed to provide the sealing member.

Note that, when the beam 7 is configured not to extend up to the second surface 5*b* side but to extend from the first surface 5*a* to the middle of the flow path 14 as described above, a configuration (E<2C+D) is easily provided that the width E of the second opening 21 of the support member 5 becomes not greater while the beam 7 is provided.

The width of the flow path 16 of the liquid supply member 4 in a communicating part with the second opening 21 is substantially the same as the width E of the second opening 21 in order not to generate a step in a communicating part with the flow path 14. This makes it possible to sufficiently ensure the bonding region of the liquid supply member 4 to be bonded to the support member 5. It is also possible to ensure a sufficient thickness for molding the liquid supply member 4.

(Heat-Dissipating Effect of Support Member)

A suitable example of, for example, a position at which the beam 8 is provided to achieve excellent temperature distribution of the liquid ejection head 1 in addition to prevention of accumulation of air bubbles and ensuring of the bonding region will be described below. Note that, the disclosure is only required to include the beam 7 as described above and it is not essential to necessarily include the beam 8.

FIGS. 4A to 4D are partial sectional views of the liquid ejection head 1 taken along the line IV-IV illustrated in FIG. 1 or 2. FIG. 4A illustrates the liquid ejection head 1 that has the support member 5, and FIGS. 4B to 4D illustrate liquid ejection heads that have the support members 51 to 53, respectively. The liquid ejection heads of FIGS. 4B to 4D have the support members which are different in positions of beams 8 and the number the beams 8, but are similar to the liquid ejection head 1 described above in other configurations.

In the support member 5 illustrated in FIG. 4A, three beams 8 are disposed in one flow path 14 at substantially equal intervals in the Y direction. In the support member 51 illustrated in FIG. 4B, seven beams 8 are disposed in one flow path 14 at substantially equal intervals in the Y direction. In the support member 52 illustrated in FIG. 4C, two beams 8 are disposed in one flow path 14 in a vicinity of both ends of the second opening 21 in the Y direction. In the support member 53 illustrated in FIG. 4D, in addition to the two beams 8 provided in the support member 52 illustrated in FIG. 4C, the beam 8 is disposed at a center part in the Y direction.

By setting that FIG. 4A is a disclosure embodiment 1, FIG. 4B is a disclosure embodiment 2, FIG. 4C is a disclosure embodiment 3, FIG. 4D is a disclosure embodiment 4, and a configuration which is obtained by eliminating the beams 8 from the support member 5 of FIG. 4A and providing only the beam 7 is a disclosure embodiment 5, the heat-dissipating effect of each of the support members is verified. Specifically, continuous ejection is performed for a fixed time from (1280) ejection ports of one array with a drive frequency of 15 KHz and temperature of the recording element board 2 immediately after the ejection is measured to examine the temperature distribution in the Y direction.

The temperature distribution is examined similarly by using the liquid ejection head including a support member, which does not include the beam 7 or the beam 8 as described in Japanese Patent Laid-Open No. 2007-276385, as a comparative example 1, and a liquid ejection head including a support member, which does not include the beam 7 but includes two beams 8 positioned at the center part in the Y direction, as a comparative example 2.

Figure 6A:
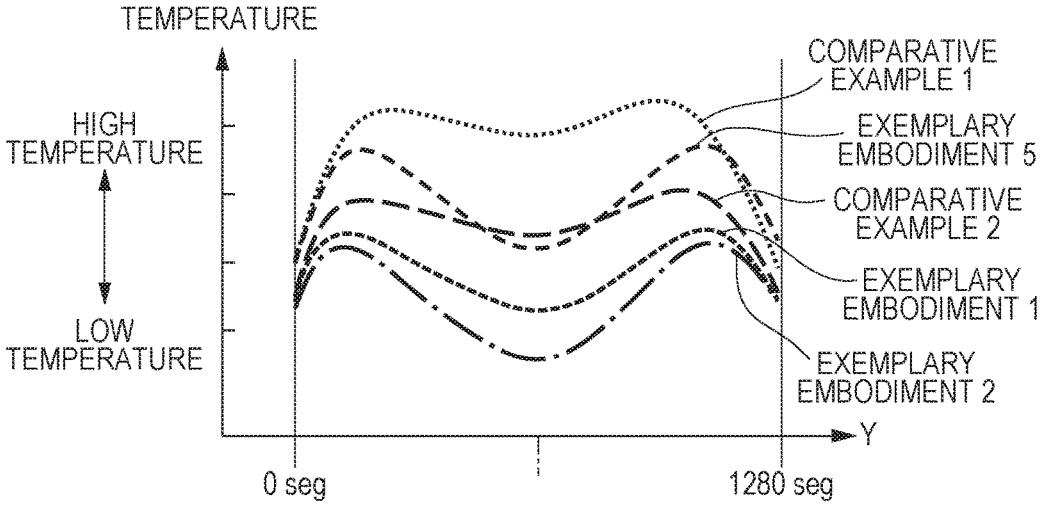
FIGS. 6A and 6B are graphs illustrating temperature distribution in an ejection port array direction after ejection in disclosure embodiments to which the disclosure is applied and comparative examples.
Figure 6B:
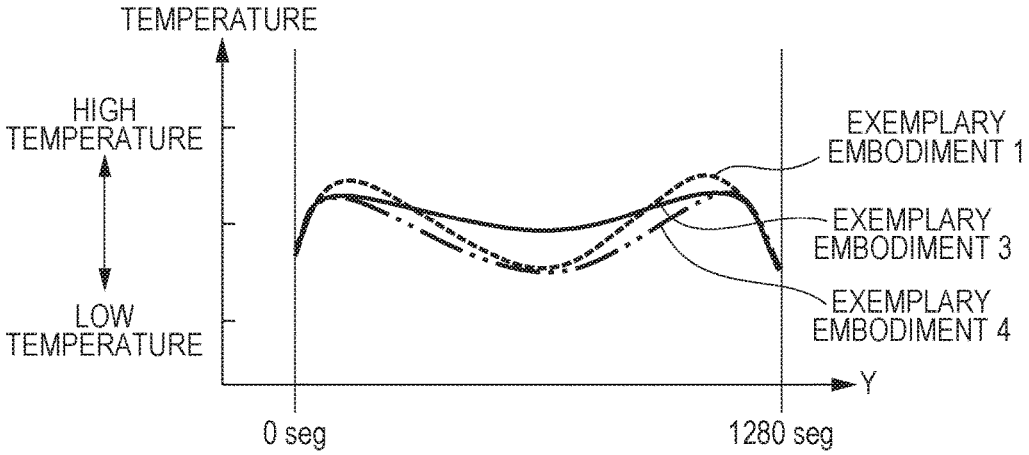

Results of the measurement are illustrated in FIGS. 6A and 6B.

Note that, in order to perform recording with high quality while the head is driven at a high speed, it is desirable that the temperature after ejection is low as a whole and a temperature variation (temperature distribution) in an ejection port array direction is small. This is because a wait time for heat dissipation is able to be made shorter when the temperature is low, so that recording is able to be performed at a higher speed. This is also because ejection volumes of the liquid are more easily equalized when a temperature difference between a center part and an end part in the ejection port array direction is small, so that recording with higher quality is able to be performed.

First, a tendency of the temperature distribution common in the liquid ejection heads that have the respective support members will be described.

As illustrated in FIGS. 6A and 6B, in all the liquid ejection heads that have the respective support members, the temperature is low at both end parts in the ejection port array direction (Y direction). This is considered to be because the both end parts have a large area in contact with the support member serving as a heat-dissipating member.

Moreover, in all the liquid ejection heads that have the respective support members, the temperature is low at the center part in the Y direction. This is considered to be affected by distribution of the speed in the flow path 14 as described below.

In the temperature measurement described above, the liquid ejection head in which a flow speed at the center part in the Y direction tends to be higher than other parts is used to supply the liquid to the recording element board 2. As illustrated in FIG. 4A, each of inner walls of the flow path 14 that are positioned at both end parts in the Y direction includes an inclined part 14*c* which is inclined so that the sectional area of the flow path 14 increases as approaching toward the first opening 22 side from the second opening 21 side. In a case where the flow path 14 includes such an inclined part 14*c*, a flow of the liquid is slow due to abrasion between the liquid and the inner wall of the flow path 14 at each of the end parts in the Y direction, so that speed distribution in which the flow speed is relatively high at the center part is considered to be obtained. It is considered that an effect of cooling by the flow of the liquid at the center part in which the flow speed of the liquid is high is greater compared to other parts and the temperature becomes low at the center part. Note that, the speed distribution tends to be large when recording is performed at a higher speed.

All the liquid ejection heads that have the respective support members indicate such temperature distribution that the temperature is high between the center part and the end parts in which the temperature is low.

Next, the temperature distributions are compared between cases where the respective support members are used.

First, the liquid ejection head that has the support member of the comparative example 1 does not include the beam 7 or the beam 8, so that a reaching temperature is high, the temperature distribution is large in the Y direction, and an obtained image has great unevenness. On the other hand, the liquid ejection head that has the support member provided with only the beam 7 as the disclosure embodiment 5 or the support member provided with only the beam 8 as the comparative example 2 exhibits a low reaching temperature because of the beam 7 or the beam 8 being provided. Further, the liquid ejection head that has the support member provided with the beam 7 and the beam 8 as the disclosure embodiments 1 to 4 exhibits a much lower reaching temperature.

In this manner, it is found that, in order to achieve the low reaching temperature, it is desirable to provide either the beam 7 or the beam 8 in the support member and it is more desirable to provide both the beam 7 and the beam 8 in the support member.

It is found as follows by comparing the temperature distributions of the liquid ejection heads that have the support members provided with the beam 7 and the beam 8. When the support member 5 of the disclosure embodiment 1 is compared to the support member 51 of the disclosure embodiment 2, the support member 51 of the disclosure embodiment 2 has the large number of the beams 8 and thus exhibits a low reaching temperature is low, but the temperature distribution is large (FIG. 6A). Though the larger number of the beams 8 is advantageous from a viewpoint of an increase in the speed, the support member 5 in which the temperature distribution is small is more desirable from a viewpoint of high image quality.

Compared to the disclosure embodiment 1 (or the disclosure embodiment 2) that has the support member in which the beams 8 are arranged at substantially equal intervals in the Y direction, the disclosure embodiment 3 or the disclosure embodiment 4 that has the support member 52 or the support member 53 in which the beams 8 are arranged near both edge parts of the second opening 21 exhibits smaller temperature distribution (FIG. 6B). Since each of the inner walls at both end parts of the flow path 14 in the Y direction includes the inclined part 14*c* that is inclined as described above, the flow of the liquid is considered to become slow particularly near the first opening 21. On the other hand, the beams 8 provided near the both edge parts of the second opening 21 are proximate to both ends of the first opening 22. Thereby, heat dissipation at a part where the cooling effect by the liquid flow is small is promoted by the beams 8, so that the temperature distribution of the head that has the support member 52 or 53 is considered to be small. When the disclosure embodiment 3 and the disclosure embodiment 4 are compared, in the disclosure embodiment 3 using the support member 52 in which the beam 8 is not provided at the center part in the Y direction, the temperature reduction at the center part is suppressed and much smaller temperature distribution is exhibited.

As described above, it is desirable that the beams 8 are provided near the both edge parts of the second opening 21 in order to achieve small temperature distribution of the liquid ejection head in the Y direction. In particular, in the liquid ejection head that indicates a tendency of the speed distribution in which the flow speed is higher at the center part than the end parts of the flow path 14 in the Y direction, the beams 8 are desired to be provided near the both edges of the second opening 21. In this case, it is more desirable that an interval a between the second opening 21 and the beam 8 (8*a*) positioned near the second opening 21 is smaller than an interval b between the adjacent beams 8 (the beam 8*a* and a beam 8*b*) as illustrated in FIG. 4D. Moreover, in order to prevent accumulation of air bubbles as described above, it is more desirable that the interval a is substantially the same as or equal to or greater than the width C that is the narrowest flow path width of the flow path 14.

(Manufacturing of Support Member)

In a case where the support member is formed by using aluminum oxide, the support member is able to be formed by cutting of aluminum oxide or the CIM described above, for example, and the CIM is able to lower costs compared to the cutting. Though the support member 52 is more desirable than the support member 53 from a viewpoint of the temperature distribution as described above, in a case where the support member is formed by using the CIM, the support member 53 is more desirable than the support member 52.

This is because the beam 7 is configured not to extend up to the second surface 5*b* from the first surface 5*a* but extend from the first surface 5*a* to the middle of the flow path 14 and the sectional area of the beam 7 is very small, so that it is difficult to form a portion of the beam 7 through injection molding. Here, a sectional area of the beam 8 along a Y-Z plane is greater than a sectional area of the beam 7 along an X-Z plane. Thus, in a case where gates 30 are disposed at four places as illustrated in FIG. 5A, a material supplied from each of the gates 30 flows from a portion serving as the beam 8 in the X direction and is filled in a portion serving as the beam 7, and the material flows in the Y direction so that the beam 7 is formed. Thus, in consideration of easiness of molding, a configuration in which the beam 8 that has a relatively large sectional area is provided in addition to the beam 7 that has a relatively small sectional area is desirable and it is more desirable that a plurality of beams 8 are provided. When the plurality of beams 8 are provided so that the adjacent beams 8 are positioned to be significantly separated from each other as in the support member 52 illustrated in FIG. 4C, the material flowing from the beams 8 is not supplied sufficiently, so that the beam 7 that is long in the Y direction is difficult to be formed in some cases. Thus, in order to further enhance moldability, a configuration in which the plurality of beams 8 intersecting the beam 7 are provided to be proximate to each other in a longitudinal direction of the beam 7 as in the support member 5 (FIG. 4A) or the support member 53 (FIG. 4D) is more desirable.

Second Example Embodiment

Next, an example configuration of the support member 5 for application of an adhesive by which the support member 5 is bonded to the recording element board 2 will be described.

(Basic Configuration of Liquid Ejection Head)

Figure 7:
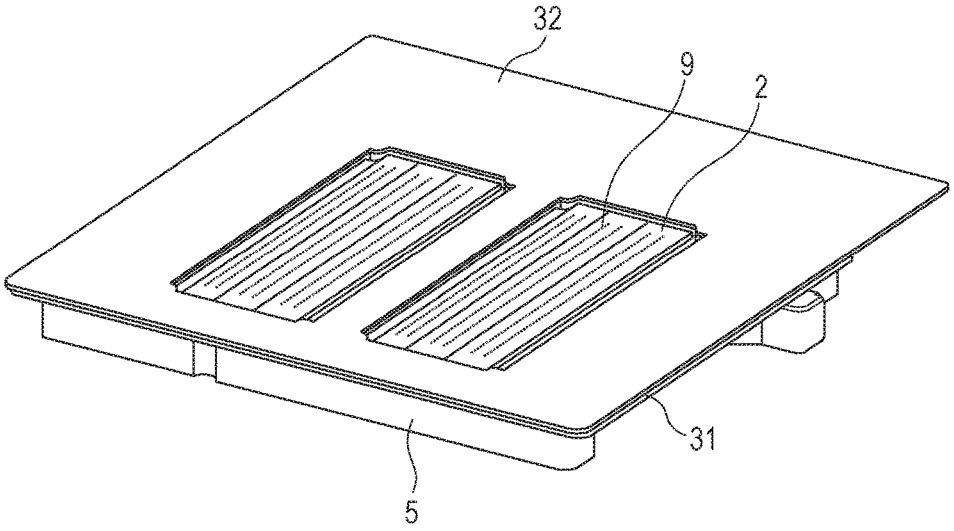
FIG. 7 is a perspective view of a liquid ejection head according to an example second embodiment of the disclosure.
Figure 8:
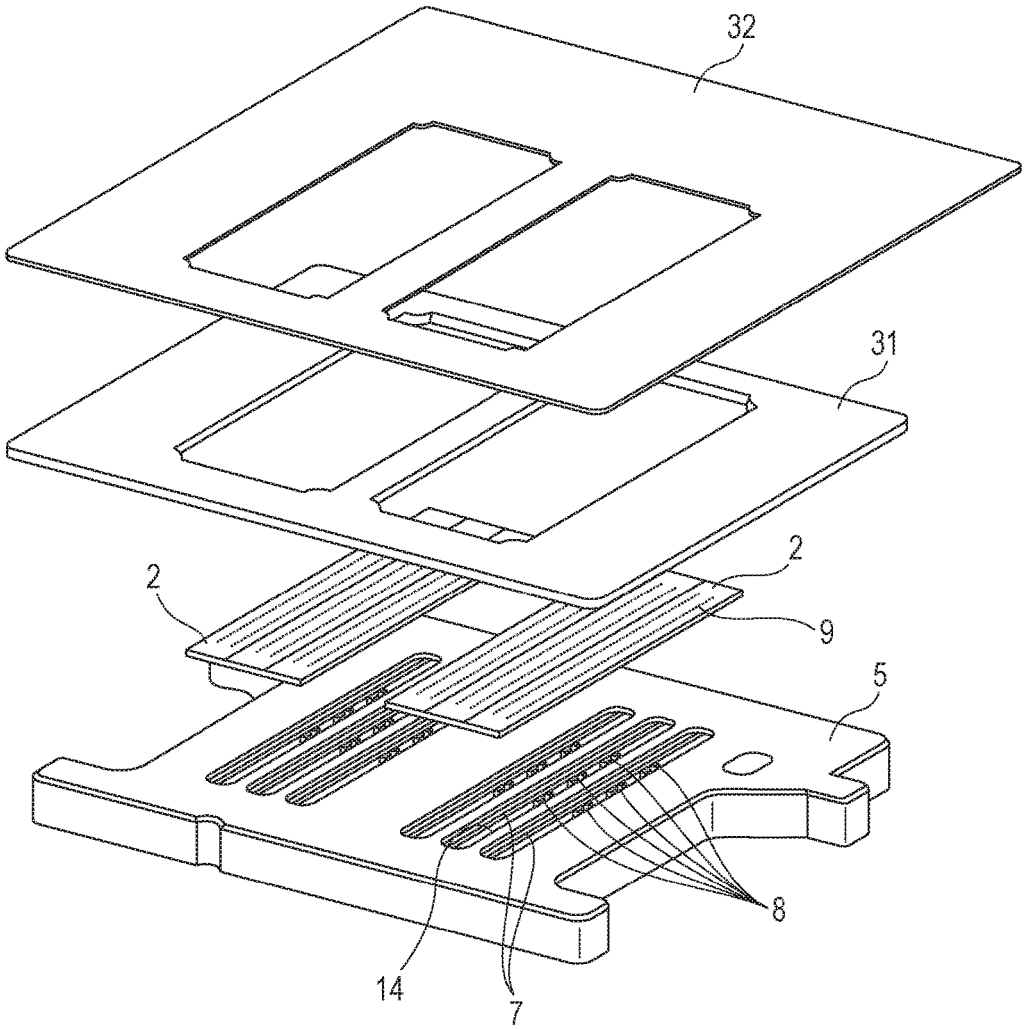
FIG. 8 is an exploded perspective view of the liquid ejection head illustrated in FIG. 7.
Figure 9:
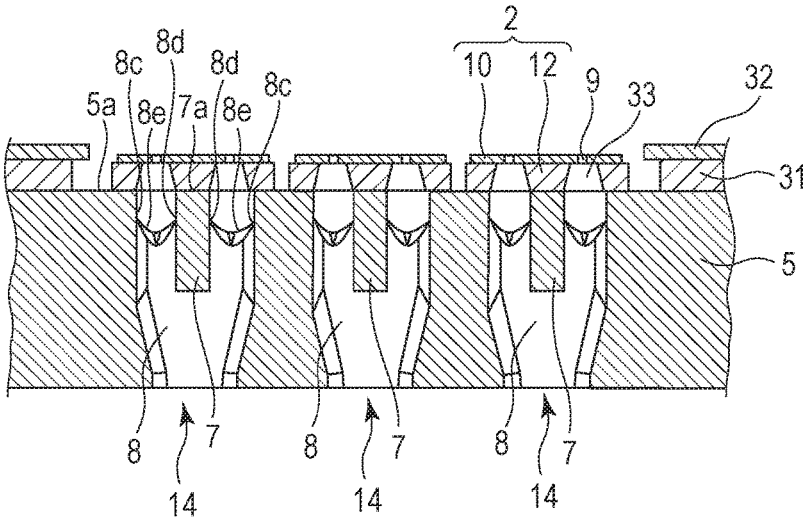
FIG. 9 is a sectional view of the liquid ejection head illustrated in FIG. 7.

FIGS. 7 to 9 respectively illustrate a perspective view, an exploded perspective view, and a sectional view of a liquid ejection head of the disclosure. In the liquid ejection head, the recording element board 2 is bonded onto a support member (first support member 5) and another support member (second support member 31) is further attached to an outer side of a portion to which the recording element board 2 is bonded. An electric wiring member 32 is disposed on the second support member 31. As illustrated in FIG. 9, the recording element board 2 has a laminate structure that includes the base 12 bonded to the first support member 5, and the ejection port plate 10 positioned opposite to a bonding surface bonded to the first support member 5. On the ejection port plate 10, ejection ports 9 serving as through holes are arranged to form a plurality of arrays. A plurality of bubble forming chambers 33 that communicate with the respective ejection ports 9 are formed on the base 12. The respective bubble forming chambers 33 constitute a plurality of bubble forming chamber arrays corresponding to a plurality of ejection port arrays. The recording element 17 such as an electro-thermal conversion element is disposed in each of the bubble forming chambers 33. The first support member 5 supports and fixes the recording element board 2 and the second support member 31, and has the flow path 14 in a groove shape for liquid to be supplied to each of the bubble forming chambers 33 of the base 12. On the first support member 5, an upper surface of the second support member 31 is positioned at almost the same height as an upper surface of the recording element board 2, and the electric wiring member 32 disposed on the second support member 31 is electrically connected to the recording element board 2. The recording element board 2 and the electric wiring member 32 are under insulation protection by a sealing material (not illustrated) and the sealing material is held inside a sealing material pool formed by an opening part of the second support member 31. With such a configuration, liquid supplied from a tank (not illustrated) or the like is guided into the bubble forming chambers 33 of the recording element board 2 through the flow path 14 of the first support member 5. When an ejection signal from a control portion (not illustrated) is transmitted to the recording element board 2 from the electric wiring member 32 and recording is driven, energy such as heat is applied to the liquid in the bubble forming chambers 33 and liquid droplets are ejected to the outside from the ejection ports 9.

Figure 10A:
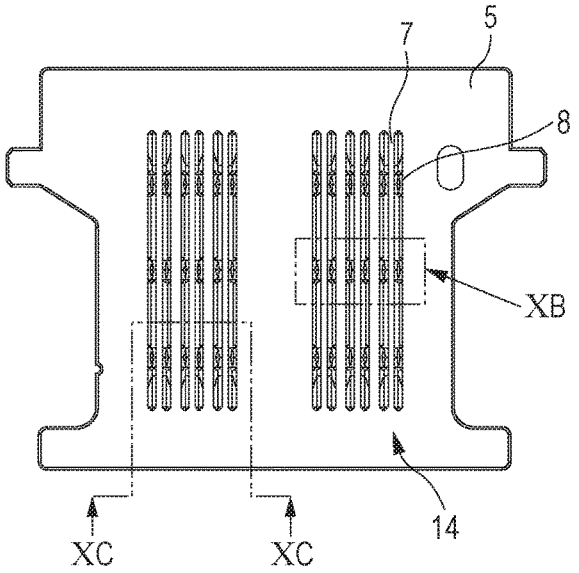
FIGS. 10A to 10C are a plan view, an enlarged perspective view of a main part, and a sectional view each illustrating a first support member of the liquid ejection head illustrated in FIG. 7.
Figure 10B:
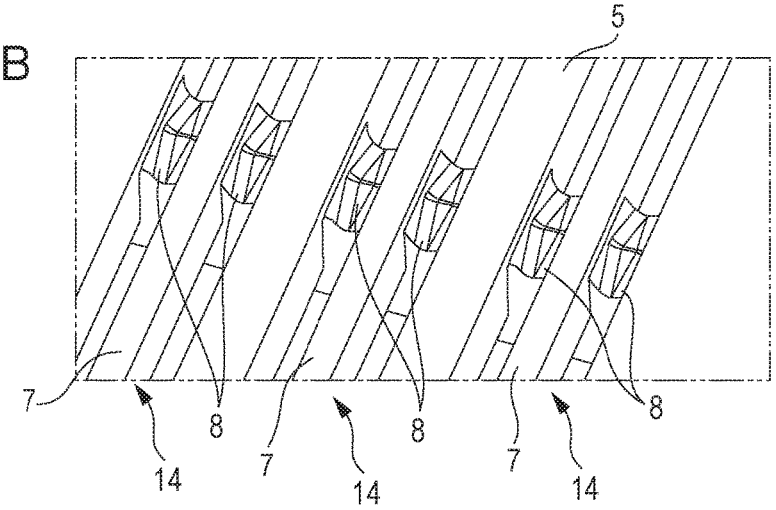
Figure 10C:
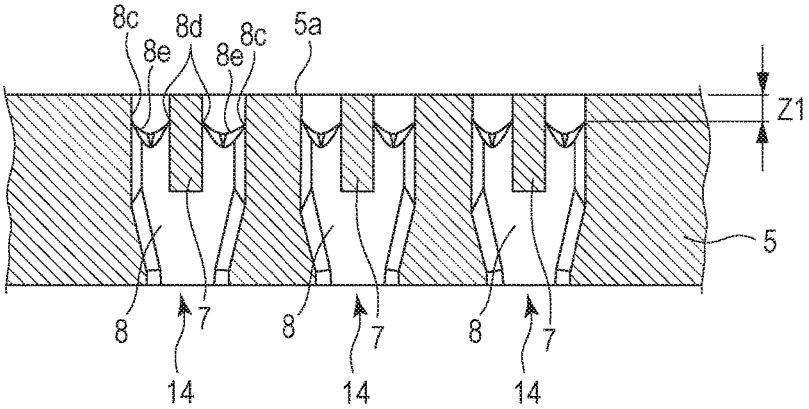

The flow path 14 of the first support member 5 according to a second embodiment of the disclosure is illustrated in FIGS. 9 and 10A to 10C. FIG. 10A is a plan view of the first support member 5, FIG. 10B is an enlarged perspective view of a part XB in FIG. 10A, and FIG. 10C is a sectional view taken along a line XC-XC in FIG. 10A. In the flow path 14 of the first support member 5, the beam 8 that is a beam in a direction crossing the flow path 14 (along a short side direction of the flow path 14) and the beam 7 that is a beam along a longitudinal direction of the flow path 14 (along a liquid flowing direction) are provided. Beams 8 crossing the flow path 14 are formed at a plurality of places (three places in the example illustrated in FIG. 10A) in one flow path 14. The beam 7 that extends along an entire length of the flow path 14 is provided along a center line of the short side of the flow path 14.

As illustrated in FIGS. 10B and 10C, a shape of each of the beams 8 along the direction crossing the flow path 14 (the short side direction of the flow path 14) is a substantially w-shape similar to the beam of Japanese Patent Laid-Open No. 2007-276385. That is, both side end parts 8*c* of the beam 8, which are connection parts connected with inner wall surfaces of a supply flow path, and intermediate parts 8*d* of the beam 8, which are connection parts connected with one surface and the other surface of the beam 7, are at high positions in the depth direction of the flow path 14. When the height of the beam 8 is viewed along the direction crossing the flow path 14, the height extends from one of the side end parts 8*c* to be further separated from the upper surface 5*a* of the support member 5 in the depth direction of the flow path 14, and then approaches again to reach one of the intermediate part (connection part connected with the one surface of the beam 7) 8*d*. Then, the height extends from the other intermediate part (connection part connected with the other surface of the beam 7) 8*d* to be further separated from the upper surface 5*a* of the support member 5 in the depth direction, and then approaches again to reach the other side end part (connection part connected with the other inner wall surface) 8*c*.

In accordance with a positional relationship illustrated in FIGS. 9 and 10C, an upper end of the beam 8 descends once in the depth direction of the flow path 14 from the one side end part 8*c*, and then ascends again to reach the one intermediate part 8*d*, descends once in the depth direction from the other intermediate part 8*d*, and then ascends again to reach the other side end part 8*c*. The beam 8 is line-symmetrical about the center line of the short side of the flow path 14. Such descent and ascent in the depth direction are not performed linearly, but form a concave part 8*e* that is curved as illustrated in FIGS. 10B and 10C.

One of features of the beam 8 of the present embodiment is that the side end parts 8*c*, that is, the connection parts connected with the inner wall surfaces of the supply flow path are at positions lower than the upper surface of the first support member 5, that is, the bonding surface 5*a* bonded to the recording element board 2 (for example, by a distance Z1) in the depth direction of the flow path 14. Moreover, the intermediate parts 8*d*, that is, the connection parts connected with the beam 7 are also at positions lower than the upper surface of the first support member 5, that is, the bonding surface 5*a* bonded to the recording element board 2 (for example, by the distance Z1) in the depth direction of the flow path 14. On the other hand, a shape of an upper part of the beam 8 along the longitudinal direction (the liquid flowing direction) of the flow path 14 is a substantially triangular shape in which the center is the highest and descent is performed toward both sides, similarly to the beam of Japanese Patent Laid-Open No. 2007-276385.

In the beam 8 of the present embodiment, the center part in the longitudinal direction of the flow path 14 and the both side end parts 8*c* and the intermediate parts 8*d* in the short side direction, that is, even the highest part of the flow path 14 in the depth direction is at a position separated from the upper surface (the bonding surface 5*a* bonded to the recording element board 2) of the first support member 5. In a positional relationship illustrated in FIGS. 9 and 10C, even the highest part of the flow path 14 in the depth direction is at a position lower than the upper surface (the bonding surface 5*a* bonded to the recording element board 2) of the first support member 5.

As illustrated in FIGS. 8, 9, and 10A to 10C, the beam 7 of the present embodiment passes through the center of the short side of the flow path 14 and extends along the longitudinal direction of the flow path 14 over the entire length thereof. As illustrated in FIG. 10C, the upper surface of the beam 7 is positioned at the same height as the upper surface of the first support member 5, that is, the bonding surface 5*a* bonded to the recording element board 2, and the lower surface of the beam 7 is positioned near the center of the flow path 14 in the depth direction. That is, the beam 7 is provided in a state of being floated in the upper part of the flow path 14 and is integrated with the beam 8 to be supported at the connection parts 8*d* (three places in the illustrated example) connected with the beam 8.

The first support member 5 that has the beam 8 and the beam 7 as described above is bonded to the recording element board 2 illustrated in FIGS. 7 to 9. Specifically, an adhesive is applied to the upper surface 5*a* of the first support member 5 and the upper surface 7*a* of the beam 7 at positions where the recording element board 2 is to be placed, and the recording element board 2 is placed thereon to be fixed by the adhesive. According to the present embodiment, reliability of bonding between the first support member 5 and the recording element board 2 by such an adhesive is high. This point will be described below.

Comparison to Comparative Example

To describe a technical meaning of the first support member 5 and the recording element board 2 according to the present embodiment, a comparative example will be described first.

Figure 11:
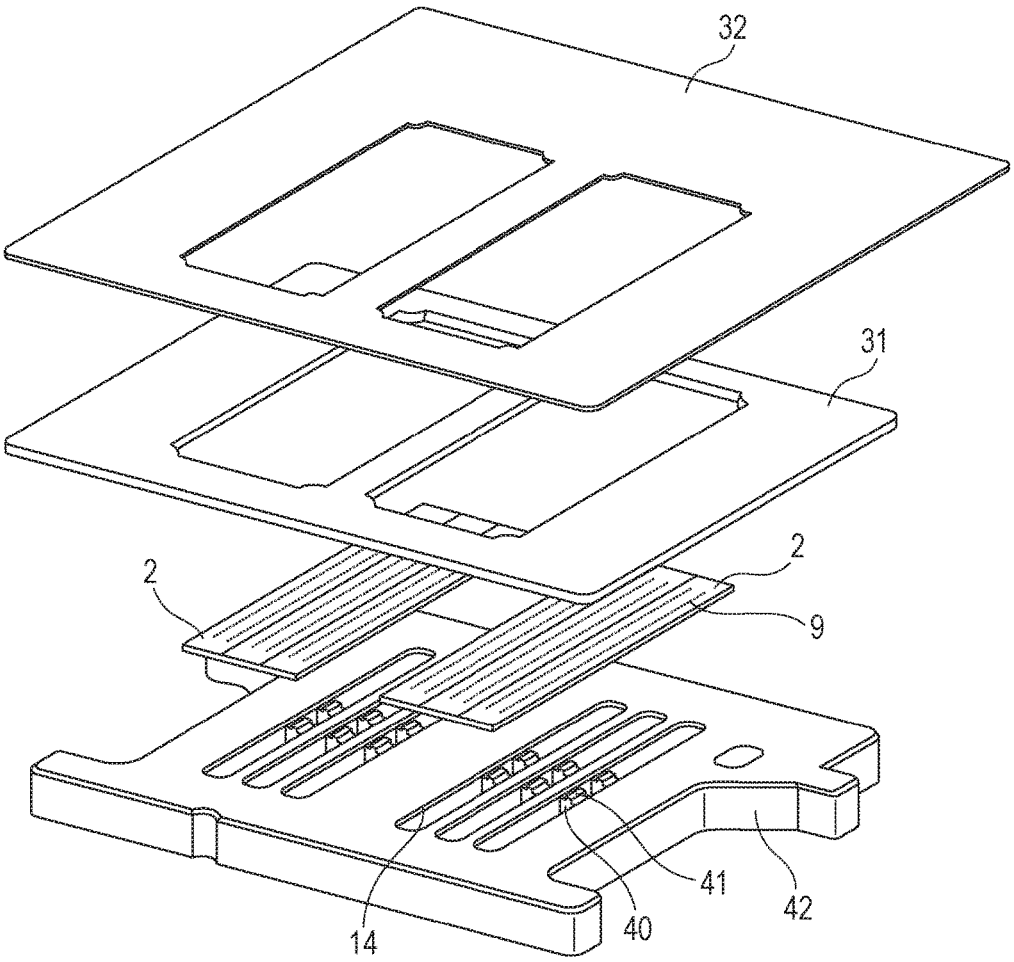
FIG. 11 is an exploded perspective view of a liquid ejection head of a comparative example.
Figure 12A:
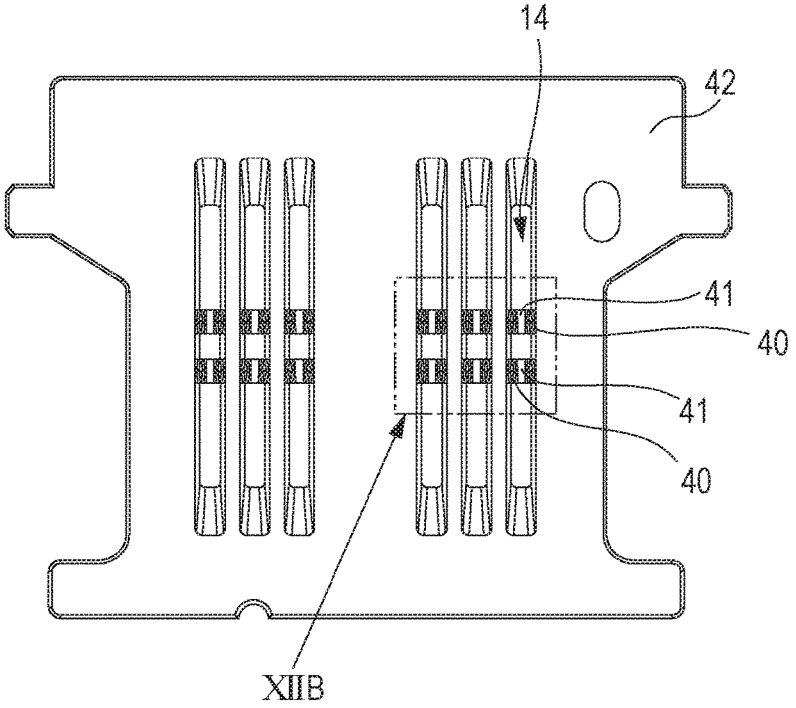
FIGS. 12A and 12B are a plan view and an enlarged perspective view of a main part each illustrating a first support member of the liquid ejection head illustrated in FIG. 11.
Figure 12B:
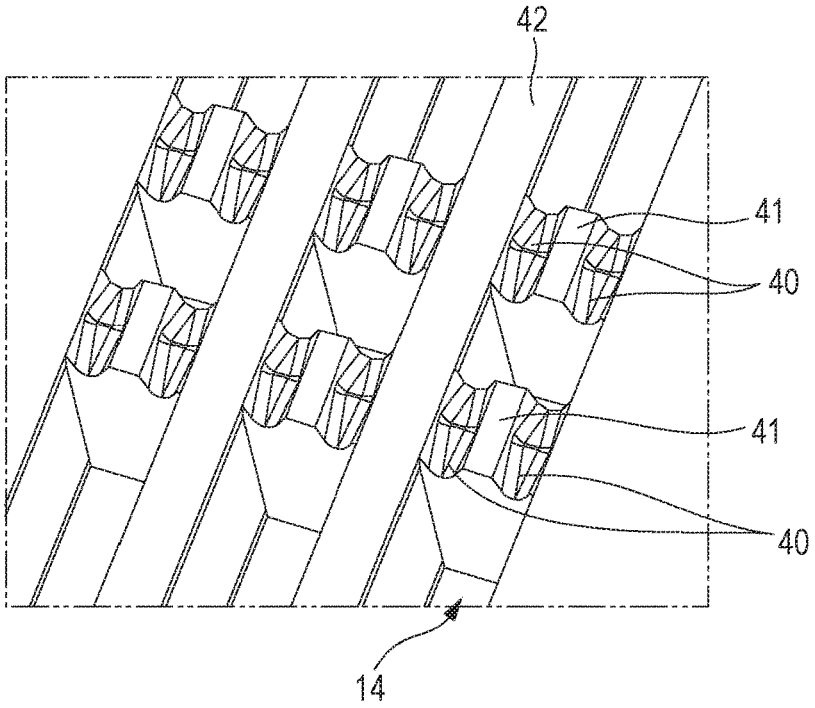

FIG. 11 is an exploded perspective view of a liquid ejection head of the comparative example to be compared to the disclosure, FIG. 12A is a plan view of a first support member 42 of the liquid ejection head, and FIG. 12B is an enlarged perspective view of a part XIIB of the first support member 42. The first support member 42 has substantially the same configuration as that of the support member of Japanese Patent Laid-Open No. 2007-276385. In the first support member 42 of the present comparative example, beams 40 crossing the flow path 14 (along the short side direction of the flow path 14) are formed at a plurality of places (two places in the example illustrated in FIG. 12A) in one flow path 14. Each of the beams 40 is similar to the aforementioned beam 8 of the second embodiment of the disclosure and a shape along the direction crossing the flow path 14 is a substantially w-shape. When a height of the beam 40 is viewed along the direction crossing the flow path 14, a line-symmetrical shape is provided so that the height descends once in the depth direction of the flow path 14 from one side end part 40*a*, and then ascends again to reach an intermediate part 40*b*, descends once from another intermediate part 40*b*, and then ascends again to reach the other side end part 40*a*. However, differently from the second embodiment, the side end parts (connection parts 40*a* connected with the inner wall surfaces of the flow path 14) and the intermediate parts (connection parts 40*b* connected with a beam 41) are positioned at the same height as an upper surface (a bonding surface 42*a* bonded to the recording element board 2) of the first support member 42 in the depth direction of the flow path 14. A center part of the beam 40 in the short side direction of the flow path 14 functions as the beam 41 that extends in a long side direction. However, the beam 41 does not extend over the entire length of the flow path 14 like the beam 7 of the second embodiment, but has the same length as the length of the beam 40 in the short side direction of the flow path 14 and each of beams 41 has an independent island shape.

When heat is generated by an electro-thermal conversion element (not illustrated) being driven in the liquid ejection head of the present comparative example, the heat is transmitted from the beam 41 that contacts the recording element board 2 to the beam 40. The heat is further transmitted from the beam 40 to the entire first support member 42 having a large surface area and dissipated. As a result, even when the liquid ejection by thermal energy is continuously performed at a high speed and high frequency, it is possible to prevent the temperature of the recording element board 2 from exceeding a usable temperature and to perform recording with high concentration by the liquid ejection. However, in such a configuration, reliability of bonding between the first support member 42 and the recording element board 2 may be lowered. A reason therefor will be described.

Figure 13:
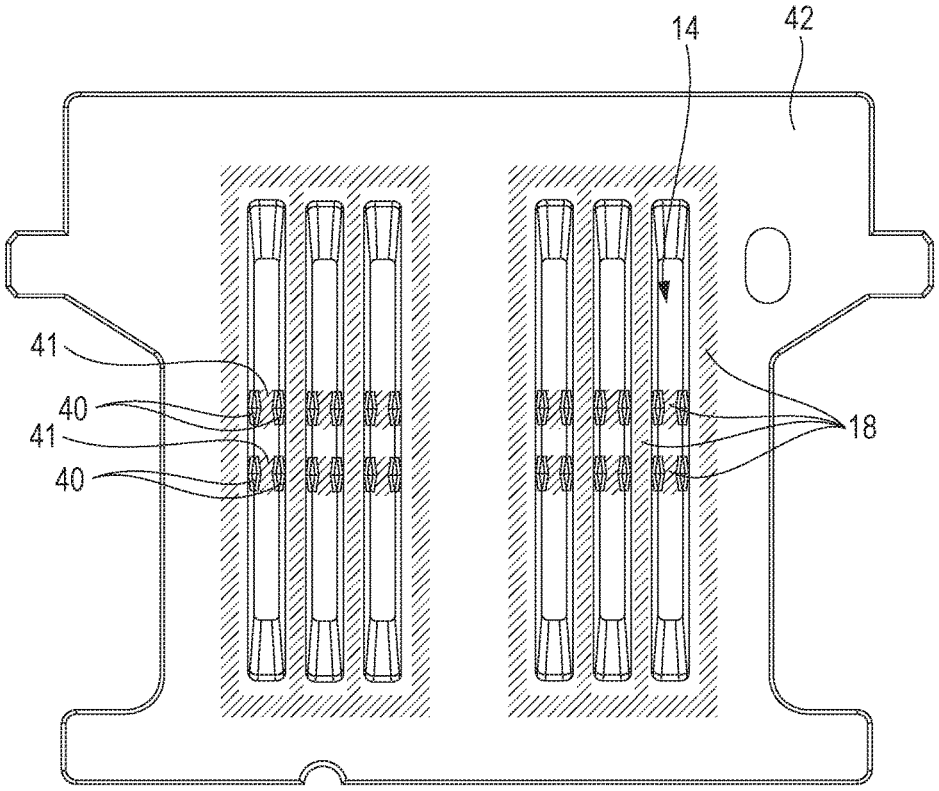
FIG. 13 is a plan view illustrating an excellent adhesive transfer step of the first support member illustrated in FIGS. 12A and 12B.
Figure 14A:
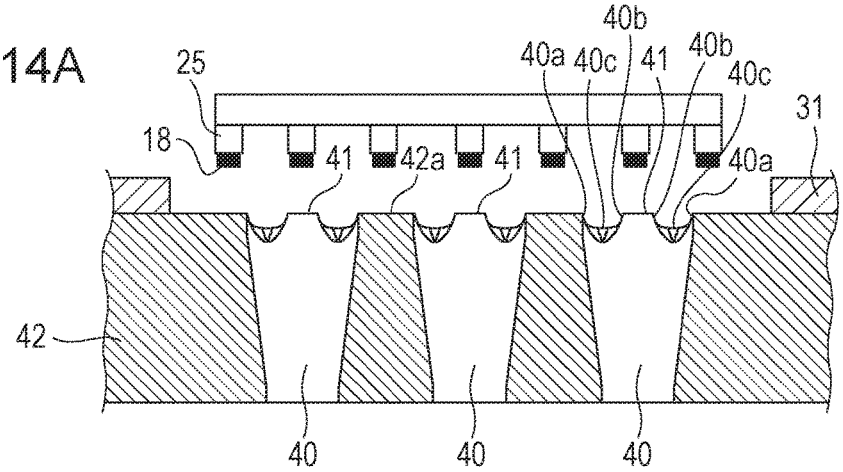
FIGS. 14A to 14C are sectional views illustrating an excellent adhesive transfer step of the first support member illustrated in FIGS. 12A and 12B.
Figure 14B:
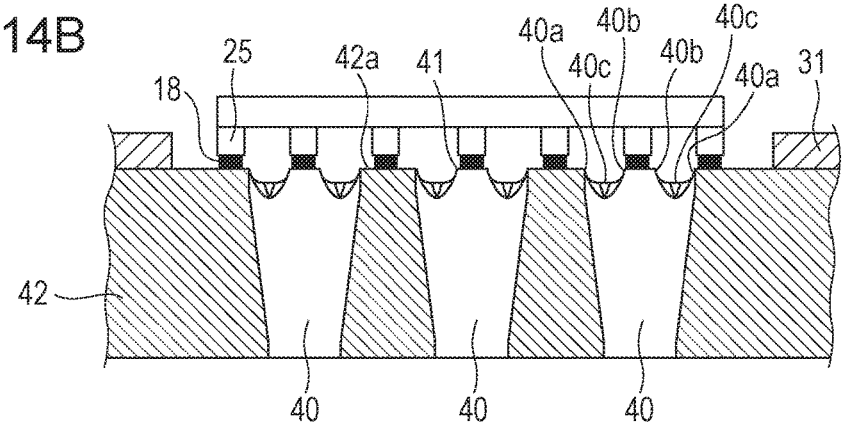
Figure 14C:
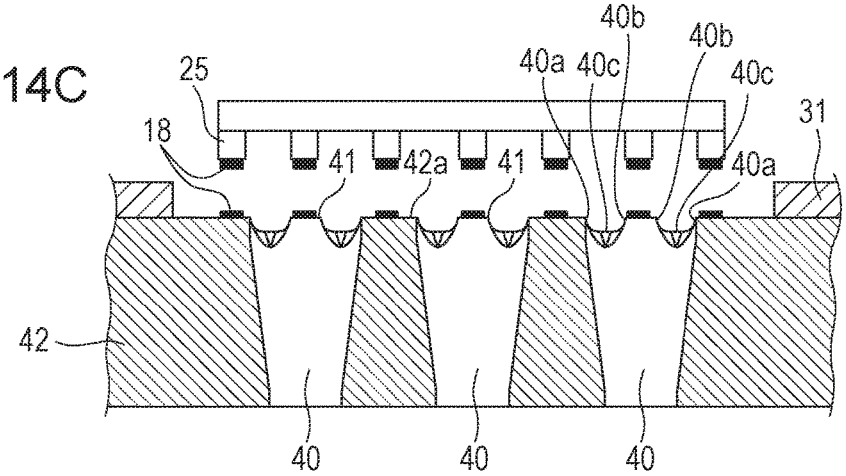

When the recording element board 2 is bonded onto the first support member 42, an adhesive 18 is applied to the upper surface 42*a* of the first support member 42 and the upper surface of the beam 41 at positions where the recording element board 2 is to be placed, and the recording element board 2 is placed thereon to be fixed by the adhesive 18. In FIG. 13, a position where the adhesive 18 is applied is indicated by the diagonal line. In examples illustrated in FIGS. 14A to 14C, a transfer pin 25 that has a tip to which the adhesive 18 is applied is pressed against the upper surface 42*a* of the first support member 42 including the beam 41, so that the adhesive 18 is transferred from the transfer pin 25 onto the upper surface 42*a* of the first support member 42 including the beam 41. When the transfer pin 25 and the first support member 42 have an appropriate positional relationship in the short side direction of the flow path 14, the adhesive 18 is exactly transferred onto the upper surface 42*a* of the first support member 42 as illustrated in FIG. 14C.

Figure 15:
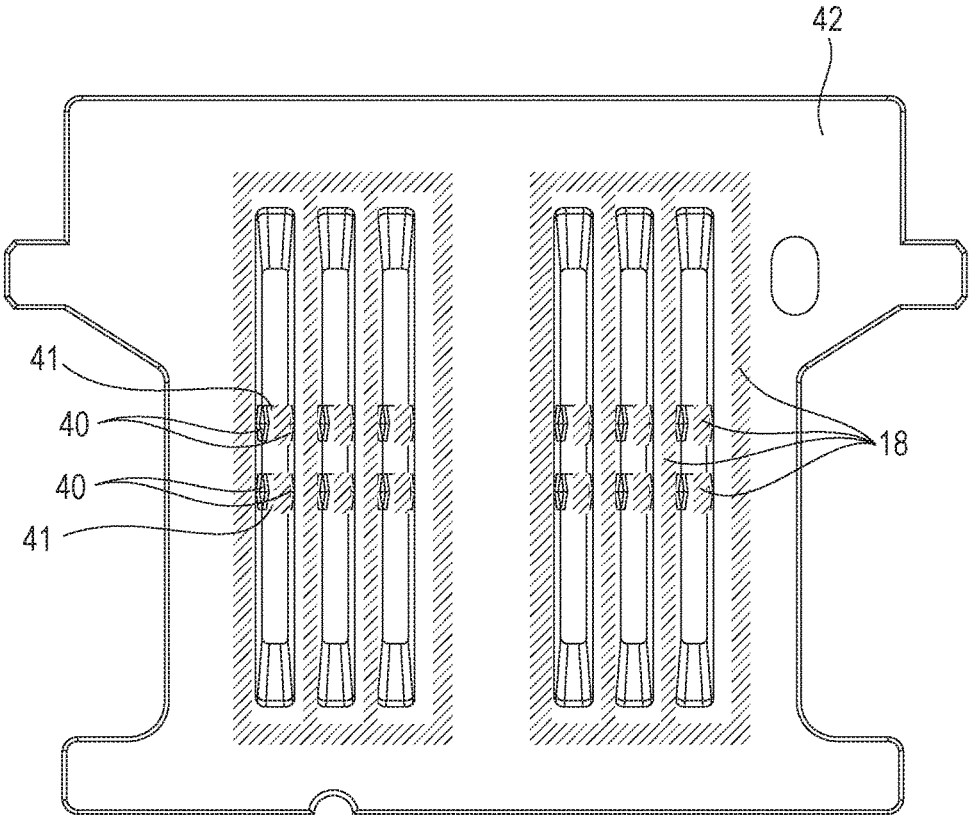
FIG. 15 is a plan view illustrating an inferior adhesive transfer step of the first support member illustrated in FIGS. 12A and 12B.
Figure 16A:
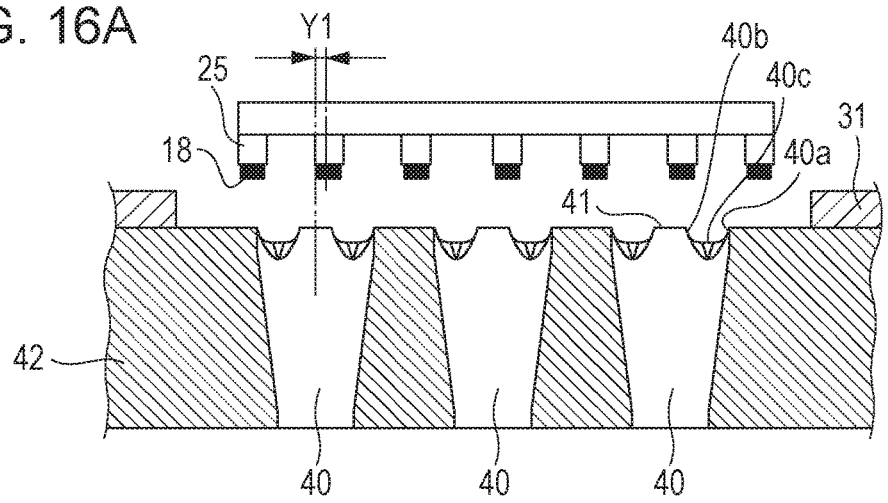
FIGS. 16A to 16C are sectional views illustrating an inferior adhesive transfer step of the first support member illustrated in FIGS. 12A and 12B.
Figure 16B:
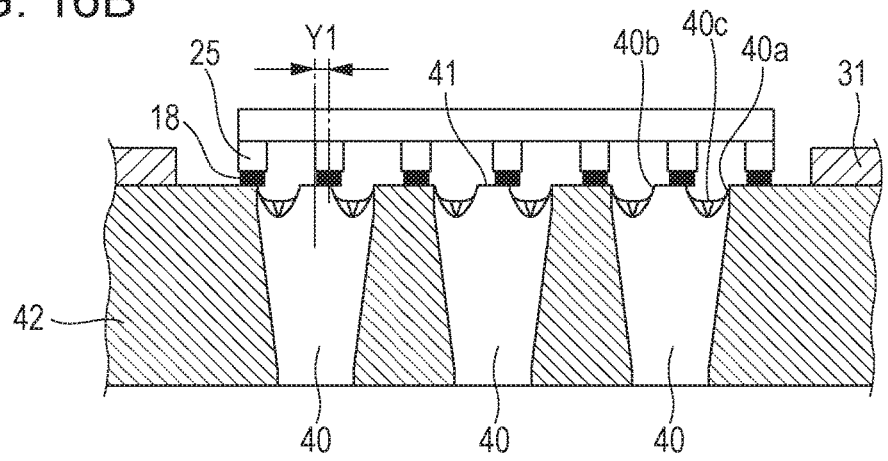

However, when a relative misalignment (for example, an amount of misalignment Y1) in the short side direction of the flow path 14 is generated between the transfer pin 25 and the first support member 42 as illustrated in FIGS. 15 and 16A to 16C, a part of the tip of the transfer pin 25 is deviated from the beam 41 or the upper surface 42*a* of the first support member 42. Then, the part of the tip of the transfer pin 25, which is deviated from the beam 41 or the upper surface 42*a* of the first support member 42, faces a concave part 40*c* that is curved between the side end part 40*a* and the intermediate part 40*b* of the beam 40. Such a state is schematically illustrated in FIGS. 15 and 16A and 16B.

In FIG. 15, a planar position of the adhesive 18 attached to the tip of the transfer pin 25 is indicted with the diagonal line. Since a part of the adhesive 18 attached to the tip of the transfer pin 25 does not abut against the beam 41 or the upper surface 42*a* of the first support member 42, the part is not transferred and positioned on the concave part 40*c* of the beam 40, which is curved. In this case, a meniscus of the adhesive 18 is caused between the tip of the transfer pin 25 and the concave part 40*c* of the beam 40 and the adhesive 18 may be drawn into the concave part 40*c* of the beam 40 due to an effect (surface tension) of the meniscus.

Figure 16C:
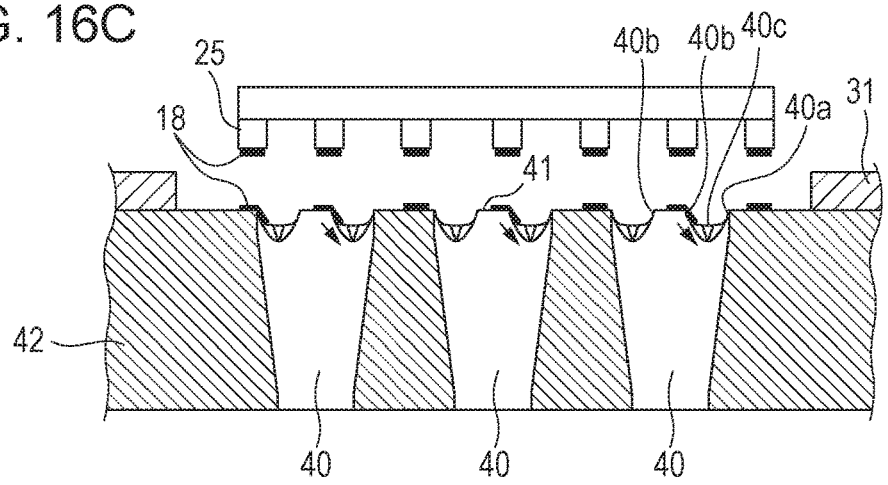

A state where the adhesive 18 is drawn into the concave part 40*c* is schematically illustrated by an arrow in FIG. 16C. As a result, the amount of the adhesive 18 transferred onto the beam 41 and the upper surface 42*a* of the first support member 42 becomes insufficient and a required amount of the adhesive 18 to bond the recording element board 2 and the first support member 42 is not obtained, so that the reliability of bonding may be lowered.

Such a problem is prominent, in particular, when a length of the beam 41 is made longer to increase a contact area of the beam 41 and the recording element board 2 for enhancing the heat-dissipating effect or when the numbers of beams 41 and beams 40 are increased so that the beams 41 and the beams 40 are provided at three or more places in one flow path, for example. This is because the amount of the adhesive 18 drawn into the concave part 40*c* of the beam 40 increases when a place where the meniscus of the adhesive 18 is caused is widened or the number of such places increases.

On the other hand, in the second embodiment of the disclosure, the connection parts 8*c* and 8*d* of the beam 8, which are connected with the inner wall surfaces of the flow path 14 and the beam 7, are at positions separated downward (for example, by the distance Z1) in the depth direction from the bonding surface 5*a* bonded to the recording element board 2, that is, a surface onto which the adhesive 18 is transferred. The tip of the transfer pin 25 that abuts against the beam 7 or the upper surface 5*a* of the first support member 5 is not proximate to the concave part 8*e* of the beam 8. Thus, the meniscus reaching the concave part 8*e* of the beam 8 is difficult to be formed by the adhesive 18 attached to the tip of the transfer pin 25.

Figure 17A:
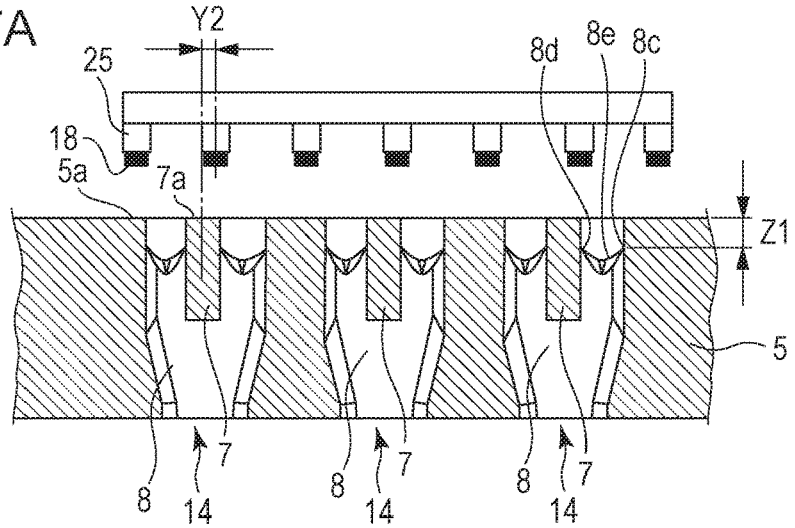
FIGS. 17A to 17C are sectional views illustrating an adhesive transfer step of the first support member illustrated in FIG. 10.
Figure 17B:
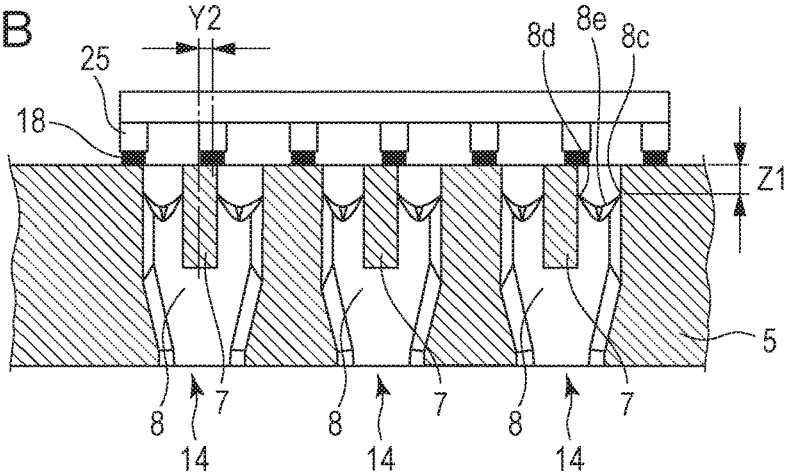
Figure 17C:
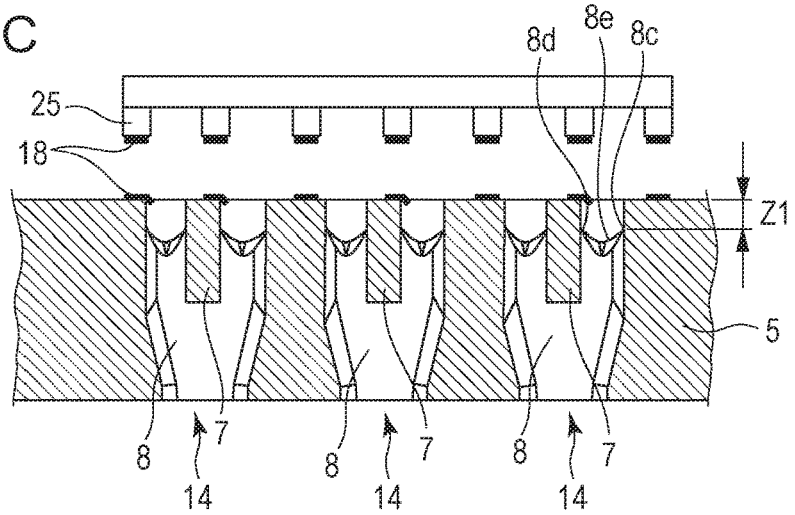

As a result, as illustrated in FIGS. 17A to 17C, even when the transfer pin 25 is at the position deviated from the upper surface 7*a* of the beam 7 or the upper surface 5*a* of the first support member 5, the adhesive 18 is not drawn into the concave part 8*e* of the beam 8. Though a slight amount of the adhesive 18 drops down by gravity, the adhesive 18 is not drawn into the concave part 8*e* due to the effect (surface tension) of the meniscus and is thus held near the beam 7 or the upper surface 5*a* of the first support member 5 as illustrated in FIG. 17C. A large part of the adhesive 18 is held near a portion where the first support member 5 and the recording element board 2 are bonded to each other to contribute to the bonding, and is positioned between the inner wall surfaces of the flow path 14 or one and the other side surfaces of the beam 7 and the bonding surface of the recording element board 2 so as to function to fix them to each other. In the second embodiment of the disclosure, since the connection parts 8*c* and 8*d* of the beam 8, which are connected with the inner wall surfaces of the flow path 14 and the beam 7, are at the positions separated downward from the bonding surface 5*a* bonded to the recording element board 2, that is, the surface onto which the adhesive 18 is transferred, it is possible to prevent lowering of the reliability of bonding.

In this manner, in the present embodiment, since it is possible to prevent lowering of the reliability of bonding between the first support member 5 and the recording element board 2, the heat-dissipating effect is able to be enhanced by increasing the length of the beam 7 (for example, by forming the beam 7 over the entire length of the flow path 14) as illustrated in FIGS. 8 and 10A. Thus, the enhancement of the heat-dissipating effect makes it possible to achieve both continuous liquid ejection at a high speed and high frequency or recording with high concentration by liquid ejection, and prevention of lowering of the reliability of bonding between the first support member 5 and the recording element board 2. Further, when the number of beams 8 increases and each of the beams 8 is configured so that the connection parts 8*c* and 8*d* connected with the inner wall surfaces of the flow path 14 and the beam 7 are at the positions separated downward in the depth direction from the bonding surface bonded to the recording element board 2 as described above, it is possible to more certainly prevent lowering of the reliability of bonding. This point will be described in detail.

In a case where a more increase in the speed of the liquid ejection and recording with higher concentration are required, when a configuration in which the beam 7 is short and the number of beams 8 is small is provided, there is a possibility that heat dissipation is insufficient and required quality (for example, recording quality) of the liquid ejection is not satisfied. Thus, the beam 7 is lengthened in the longitudinal direction to increase the contact area with the recording element board 2, and the number of beams 8 is further increased or thickness of the beam 8 is increased, so that enhancement of heat-dissipating performance is able to be expected. In this case, it is concerned that the amount of the adhesive 18 by which the recording element board 2 is fixed to the first support member 5 becomes lacking and the reliability of bonding is lowered. When the number of beams 8 is small (for example, two), less influence is given even when misalignment is caused during transfer of the adhesive 18 by which the recording element 2 is bonded and fixed and the adhesive 18 drops down to a side of the beam 7, the concave part 8*e* of the beam 8, or the like. However, when the beam 7 is lengthened, the number of beams 8 is increased, or the beam 8 is widened in order to enhance heat-dissipating performance, it is concerned that an amount of the adhesive 18 that leaks to the side of the beam 7, the concave part 8*e* of the beam 8, or the like and reaches a region where the adhesive 18 does not contribute to bonding increases, so that inconvenience is caused. In the present embodiment, the connection parts 8*c* and 8*d* of the beam 8, which are connected with the inner wall surfaces of the flow path 14 and the beam 7, are not on the same surface as a surface 1*a* onto which the adhesive 18 is transferred and are at positions separated downward.

Accordingly, the meniscus reaching the concave part is hard to be formed and the adhesive 18 is less likely to be drawn into the concave part 8*e* of the beam 8, so that possibility that a sufficient amount of the adhesive 18 stays in a region where the adhesive 18 contributes to bonding between the first support member 5 and the recording element board 2 is high. As a result, enhancement of heat-dissipating performance is able to be achieved by lengthening the beam 7 or increasing the number of the beams 8 or thickness of the beam 8, without concern for lowering of the reliability of bonding between the first support member 5 and the recording element board 2.

Note that, the applicant of the present application conducted an experiment as follows. The amount of the adhesive 18 to be transferred was maximized, and when misalignment in the short side direction of the flow path 14 between the transfer pin 25 and the first support member 5 became the largest, a state where the adhesive 18 was drawn into the concave part 8*e* of the beam 8 was observed. According to the experiment, in the first support member 5 having a thickness of 3.0 mm or more, the distance Z1 by which the connection parts 8*c* and 8*d* of the beam 8, which are connected with the inner wall surfaces of the flow path 14 and the beam 7, are separated from the bonding surface 5*a* bonded to the recording element board 2 is preferably in a range of 0.5 mm to 1.0 mm. In this case, not much adhesive 18 was drawn into deep inside the concave part 8*e* of the beam 8 and excellent bonding was realized between the first member 5 and the recording element board 2.

Though ceramic is used as an example of the material of the first support member 5, the material is not limited thereto and other various materials may be used.

Example Third Embodiment

Figure 18A:
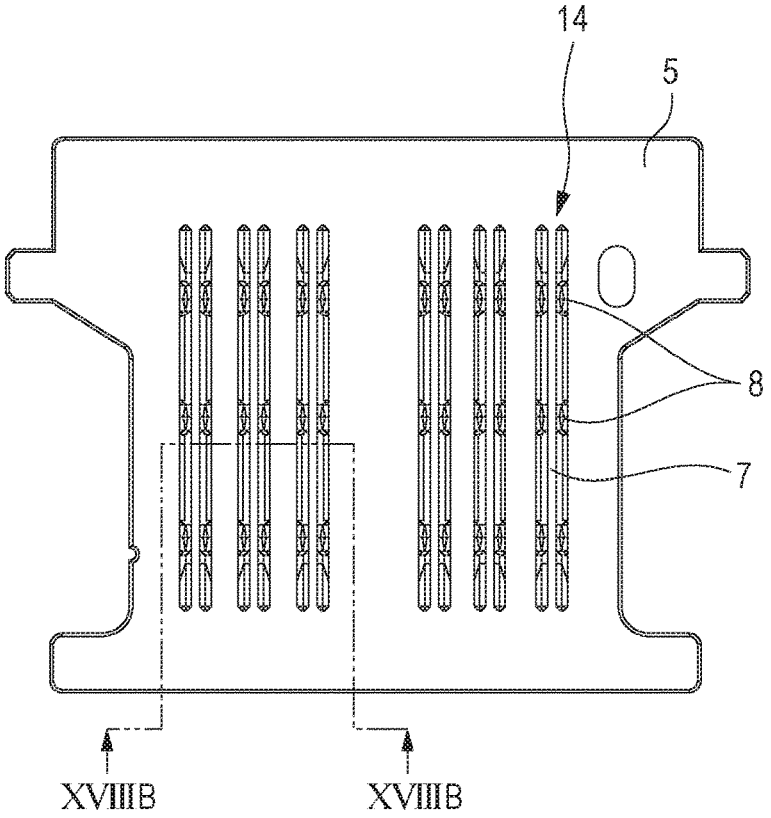
FIGS. 18A and 18B are a plan view and a sectional view illustrating a first support member of a liquid ejection head of an example third embodiment of the disclosure.
Figure 18B:
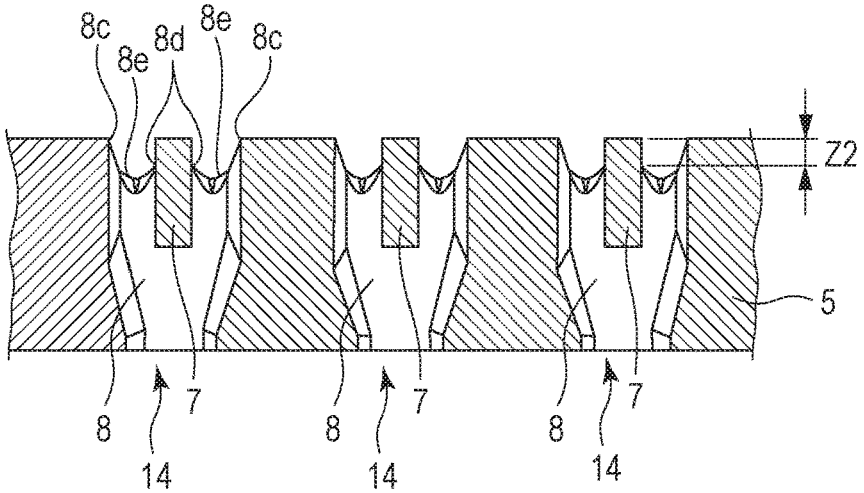

FIGS. 18A and 18B illustrate an example third embodiment of the disclosure, FIG. 18A is a plan view of a first support member 42 of a liquid ejection head of the third embodiment, and FIG. 18B is a sectional view taken along a line XVIIIB-XVIIIB in FIG. 18A. In the present embodiment, the connection part 8*d* of the beam 8, which is connected with the beam 7, is not at the same height as the surface 1*a* onto which the adhesive 18 is transferred but is at a position separated downward by a distance Z2 in the depth direction of the flow path 14. On the other hand, the connection part 8*c* of the beam 8, which is connected with the inner wall surface of the flow path 14, is at the same height as the surface 5*a* onto which the adhesive 18 is transferred. A technical meaning thereof is as follows.

In a case where a wide pitch is able to be provided between flow paths 14, even when a part of the adhesive 18 at a position serving as the inner wall surface of each of the flow paths 14 leaks, the reliability of bonding between the first support member 5 and the recording element board 2 is not greatly lowered. Thus, even when the connection part 8*c* of the beam 8, which is connected with the inner wall surface of the flow path 14, is at the same height as the upper surface 5*a* of the first support member 5, a certain degree of misalignment between the transfer pin 25 and the first support member 5 is able to be allowed.

With such a configuration, the surface area of the beam 8 is large, so that heat-dissipating performance is enhanced. However, in a case where a sufficient amount of the adhesive 18 is required for the upper surface of the beam 7, the connection part 8*d* of the beam 8, which is connected with the beam 7, can be at a lower position separated from the upper surface 5*a* of the first support member 5, similarly to the second embodiment.

Because of a reason that the width of the beam 7 is able to be widened, for example, there is also a case where the reliability of bonding between the first support member 5 and the recording element board 2 is not greatly lowered even when a part of the adhesive 18 on the upper surface of the beam 7 leaks. In such a case, the connection part 8*d* of the beam 8, which is connected with the beam 7, may be at the same height as the upper surface 5*a* of the first support member 5. On the other hand, in a case where the pitch between flow paths 14 is narrow, the connection part 8*c* of the beam 8, which is connected with the inner wall surface of the flow path 14, can be at a lower position separated from the upper surface 5*a* of the first support member 5.

As illustrated in FIGS. 18A and 18B, a configuration in which the connection part 8*c* of the beam 8, which is connected with the inner wall surface of the flow path 14, is at the same height as the upper surface 5*a* of the first support member 5 and the connection part 8*d* connected with the beam 7 is at the position separated downward from the upper surface 5*a* of the first support member 5 is included in the scope of the disclosure. Though not illustrated, similarly, a configuration in which the connection part 8*d* of the beam 8, which is connected with the beam 7, is at the same height as the upper surface 5*a* of the first support member 5 and the connection part 8*c* connected with the inner wall surface of the flow path 14 is at the position separated downward from the upper surface 5*a* of the first support member 5 is also included in the scope of the disclosure. The beam 8 illustrated here has connection parts 8*c* connected with one inner wall surface and the other inner wall surface of the flow path and the connection parts 8*d* connected with one surface and the other surface of the beam 7.

Any of the configuration in which both the connection parts 8*c* and 8*d* are at positions separated from the upper surface 5*a* of the first support member 5 as in the second embodiment and the configuration in which only any one of the connection parts 8*c* and 8*d* is at the position separated from the upper surface 5*a* of the first support member 5 as in the third embodiment and a modified example thereof may be used. The configuration to be selected may be set as appropriate in accordance with the width of the beam 7, the pitch between flow paths 14, or the like.

According to the disclosure, it is possible to enhance a heat-dissipating effect by increasing a size of a shape of the beam 7 or the beam 8 or increasing the number of beams 7 or beams 8. In addition, even when a transfer position of the adhesive 18 is slightly shifted, for example, due to misalignment between the transfer pin 25 and the first support member 5, the adhesive 18 is able to be prevented from being drawn into a region where the adhesive 18 does not contribute to bonding between the first support member 5 and the recording element board 2. As a result, stability of transfer of the adhesive is obtained and the reliability of bonding between the support member 5 and the recording element board 2 is prevented from being lowered.

While the present disclosure has been described with reference to multiple example disclosure embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-046211 filed Mar. 10, 2017 and Japanese Patent Application No. 2017-046419 filed Mar. 10, 2017, which are hereby incorporated by reference herein in their entirety.

What is claimed is:

1. A liquid ejection head comprising:

a recording element board including a first element and a second element that are used to perform recording, a first supply port that supplies liquid to the first element, and a second supply port that supplies liquid to the second element;

a supply member including a supply path through which liquid is supplied to the recording element board; and a support member that supports the recording element board, and includes a first surface having a plurality of first openings that communicate with the first supply port and the second supply port, a second surface contacting the supply member and having a second opening that communicates with the supply path, and a flow path through which the plurality of first openings and the second opening communicate with each other, wherein the support member includes a first beam that is provided between the plurality of first openings and extends from the first surface to middle of the flow path, and in an arrangement direction of the plurality of first openings, a length of the second opening is shorter than a sum of lengths of the plurality of first openings and a length of the first beam on the first surface.

2. The liquid ejection head according to claim 1, wherein in the arrangement direction, the length of the second opening is longer than a length of one of the first openings.

3. The liquid ejection head according to claim 1, wherein a flow path part of the flow path, which is a part in which the first beam extends from one of the first openings, has a length in the arrangement direction that is substantially the same as the length of one of the first openings in the arrangement direction or longer than the length of the first opening.

4. The liquid ejection head according to claim 1, wherein the support member includes a plurality of second beams, which are different from the first beam and each of which connects inner walls forming the flow path and the first beam in the arrangement direction.

5. The liquid ejection head according to claim 4, wherein each of the plurality of second beams extends from the second opening to middle of the flow path directed to the first opening.

6. The liquid ejection head according to claim 4, wherein the second opening has a length in a direction intersecting the arrangement direction that is longer than a length in the arrangement direction, and at least one of the plurality of second beams is provided near an edge of the second opening in the intersecting direction.

7. The liquid ejection head according to claim 6, wherein an interval between the edge of the second opening and one of the plurality of second beams provided near the edge is substantially the same as the length of one of the first openings in the arrangement direction or longer than the length of the first opening.

8. The liquid ejection head according to claim 6, wherein an interval between the edge of the second opening and one of the plurality of second beams provided near the edge is shorter than an interval between adjacent two of the plurality of second beams.

9. The liquid ejection head according to claim 4, wherein the plurality of second beams are provided at a substantially equal interval.

10. The liquid ejection head according to claim 4, wherein a sectional area of the first beam in the arrangement direction is smaller than a sectional area of each of the plurality of second beams in a direction intersecting the arrangement direction.

11. The liquid ejection head according to claim 4, wherein each of the plurality of second beams extends from a connection part connected with one of the inner walls and reaches a connection part connected with one surface of the first beam, and further extends from a connection part connected with the other surface of the first beam and reaches a connection part connected with the other inner wall, and in the plurality of second beams, either or both of the connection parts connected with the inner walls and the connection parts connected with the first beam are at positions separated from the first surface of the support member in a depth direction of the flow path.

12. The liquid ejection head according to claim 11, wherein a thickness of the support member is 3.0 mm or more, and the connection part that is at the position separated from the first surface of the support member in the depth direction among the connection parts of the plurality of second beams, which are connected with the inner walls, and the connection parts of the plurality of second beams, which are connected with the first beam, is at a position separated from the first surface by a distance in a range of from 0.5 mm to 1.0 mm in the depth direction.

13. The liquid ejection head according to claim 1, wherein the supply member is made from a resin material.

14. The liquid ejection head according to claim 1, wherein the support member is made from aluminum oxide.

15. A liquid ejection apparatus ejecting liquid by using a liquid ejection head that includes:

a recording element board including a first element and a second element that are used to perform recording, a first supply port that supplies liquid to the first element, and a second supply port that supplies liquid to the second element;

a supply member including a supply path through which liquid is supplied to the recording element board; and a support member that supports the recording element board, and includes a first surface having a plurality of first openings that communicate with the first supply port and the second supply port, a second surface contacting the supply member and having a second opening that communicates with the supply path, and a flow path through which the plurality of first openings and the second opening communicate with each other, wherein the support member includes a first beam that is provided between the plurality of first openings and extends from the first surface to middle of the flow path, and in an arrangement direction of the plurality of first openings, a length of the second opening is shorter than a sum of lengths of the plurality of first openings and a length of the first beam on the first surface.

16. A method for manufacturing a liquid ejection head that includes:

a recording element board including a first element and a second element that are used to perform recording, a first supply port that supplies liquid to the first element, and a second supply port that supplies liquid to the second element;

a supply member including a supply path through which liquid is supplied to the recording element board; and a support member that supports the recording element board, and includes a first surface having a plurality of first openings that communicate with the first supply port and the second supply port, a second surface contacting the supply member and having a second opening that communicates with the supply path, and a flow path through which the plurality of first openings and the second opening communicate with each other, the method comprising:

forming the support member in such a manner that the support member includes a first beam that is provided between the plurality of first openings and extends from the first surface to middle of the flow path and a second beam that is different from the first beam and connects inner walls forming the flow path and the first beam in an arrangement direction of the plurality of first openings, wherein in the forming the support member, the first beam is formed by supplying a material from a portion serving as the second beam to a portion serving as the first beam.

17. The method for manufacturing a liquid ejection head according to claim 16, wherein the first beam is formed in such a manner that a sectional area of the first beam in the arrangement direction is smaller than a sectional area of the second beam in a direction intersecting the arrangement direction.

* * * * *